US005815775A

United States Patent [19]

Miyasaka et al.

[11] Patent Number: 5,815,775

[45] Date of Patent: Sep. 29, 1998

[54] COLOR ELECTRO-PHOTOGRAPHIC APPARATUS

[75] Inventors: Toru Miyasaka; Masashi Yamamoto, both of Hitachi; Nobuyoshi Hoshi, Hatachinaka; Seiji Maruo, Hitachi, all of Japan

[73] Assignee: Hitachi, Ltd., Tokyo, Japan

[21] Appl. No.: 870,594

[22] Filed: Jun. 6, 1997

Related U.S. Application Data

[63] Continuation of Ser. No. 412,122, Mar. 28, 1995, Pat. No. 5,666,599.

[30] Foreign Application Priority Data

Apr. 6, 1994 [JP] Japan ..... 6-068295
Sep. 5, 1994 [JP] Japan ..... 6-210931

[51] Int. Cl.[6] ..... G03G 15/01; G03G 15/14

[52] U.S. Cl. ..... 399/162; 399/223; 399/302

[58] Field of Search ..... 399/162, 107, 399/223, 302, 308, 116, 121, 119, 297, 298

[56] References Cited

U.S. PATENT DOCUMENTS 4,901,110 2/1990 Tompkins et al. ..... 399/302
4,933,727 6/1990 Mizuma et al. ..... 399/298
5,160,969 11/1992 Mizuma et al. ..... 399/223
5,444,515 8/1995 Haneda et al. ..... 399/223 X
5,512,986 4/1996 Toyomura et al. ..... 399/308 X

*Primary Examiner*—S. Lee
*Attorney, Agent, or Firm*—Antonelli, Terry, Stout & Kraus, LLP

[57] ABSTRACT

A color electro-photographic apparatus including a photosensitive belt disposed for movement along a path in which a major portion of the path extends in a substantially vertical direction, a plurality of developing units arranged in a stack along one side of the photosensitive belt, and an intermediate transfer body disposed adjacent an other side of the photosensitive belt at a lower portion thereof. The color electro-photographic apparatus also includes a paper cassette extending in a horizontal direction at a part of the apparatus below the photosensitive belt so that paper travels from an end of the paper cassette along a vertical path without bending back upon itself prior to image transfer by the intermediate transfer body.

24 Claims, 19 Drawing Sheets

COLOR ELECTRO-PHOTOGRAPHIC APPARATUS

This application is a Continuation of application Ser. No. 08/412,122, filed Mar. 28, 1995 U.S. Pat. No. 5,666,599.

BACKGROUND OF THE INVENTION

The present invention relates to an apparatus performing color image printing, and more particularly relates to a small-size color image printing apparatus utilizing electro-photographic-process.

In the past, there has been an electro-photographic printing apparatus utilizing electoro-photography as an apparatus for printing a color image using image information from a computer or the like. The electro-photography has a disadvantage in that it is complex in structure, difficult in handling of the apparatus and large in size of the entire apparatus because of plenty of printing processes. Particularly, if developing units for four colors are arranged around a photosensitive drum, the apparatus becomes complex in that each of the developing units is required to change its structure and at the same time the diameter of the photosensitive drum becomes large. Therefore, a photosensitive body having a comparatively small diameter is employed and at the same time a switching method using a mechanism for sliding or rotating the four developing units is also employed. The technology is described in, for example, Japanese Patent Application Laid-Open No.2-189562 (1990) and Japanese Patent Publication No.2-13304 (1990). However, the apparatus having this construction is complex and not easy in handling because the mechanism for drive the developing units is required.

On the other hand, a method is proposed in Japanese Patent Application Laid-Open No.2-213884, (1990), where a photosensitive body is formed in a belt and three or four developing units are arranged in making use of the flat surface portion of the photosensitive body.

However, it has been difficult for the conventional electro-photographic apparatuses to satisfy quality of image, speed of printing, easiness of maintenance and size of apparatus at a time. There occurs any one or more of degradation in quality of image, lowering in speed of printing and increase in size of apparatus. Therefore, although various methods have been proposed, it has not been realized to provide a high-quality-image and small-size color electro-photographic apparatus having a size capable of using as a desk-top apparatus.

SUMMARY OF THE INVENTION

An object of the present invention is to provide a small-size color electro-photographic apparatus having a size capable of easily using as a desk-top apparatus and satisfying quality of image, speed of printing, easiness of maintenance at a time by means of systematically studying printing processes of such as photosensitive belt, intermediate transfer drum charging unit, exposing unit, developing unit, transfer unit, fixing unit and so on, a paper transporting path, and construction and arrangement including unitizing each of the components.

In order to attain the above object, a drum is employed as the intermediate transfer drum and a photosensitive belt having a length equal to the outer peripheral length of the intermediate transfer drum is arranged in vertically stretching. Developing units of the same shape are arranged in one side of the photosensitive belt, and a charging unit and a cleaner are arranged in the other side. The intermediate transfer drum is placed under or diagonally under the photosensitive belt. A transfer mechanism for transferring an image on the intermediate transfer drum to a sheet of paper is placed under or diagonally under the intermediate transfer drum.

In the above construction, it is possible to get the rotating cycle of the photosensitive belt agreeing with that of the intermediate transfer drum because of employing the photosensitive belt having a length equal to the peripheral length of the intermediate transfer drum. Therefore, it is easy to obtain sufficient accuracy of color superposition in superposing an image of each color. In the above construction, it is possible to lessen the entire size of the apparatus because of employing the photosensitive belt having a length equal to the peripheral length of the intermediate transfer drum. Further, it is comparatively easy to construct a thin developing apparatus because the photosensitive body of belt-shape is arranged in vertically stretching and the developing units are arranged in one side of the photosensitive body. Furthermore, it is possible to place the means transferring to a paper in a position under the intermediate transfer drum where is effective for stable peeling-off of the paper because the intermediate transfer drum is placed under the photosensitive belt.

DETAILED DESCRIPTION OF THE PREFERRED EMBODIMENTS

Embodiments of the present invention will be described detail below, referring to FIG. 1 to FIG. 32.

Figure 1:
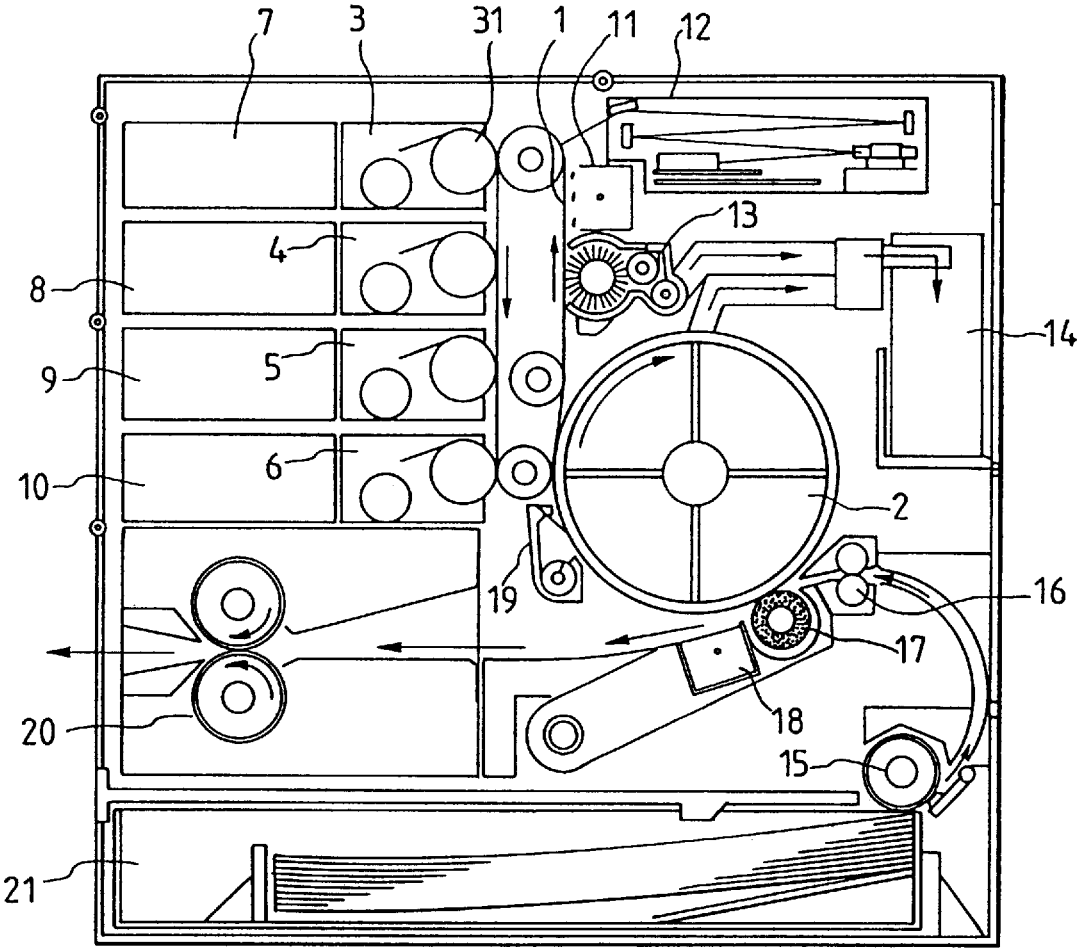
FIG. 1 is a view showing the entire construction of an embodiment of a color electro-photographic apparatus in accordance with the present invention.

FIG. 1 is a view showing the construction of an embodiment of a small-size color image printing apparatus utilizing electro-photographic process in accordance with the present invention.

In the beginning, an outline of operation of each part during color image printing using the apparatus. The apparatus comprises a photosensitive belt 1 and an intermediate transfer drum 2. The rotating photosensitive belt 1 is uniformly charged by a charging unit 11. Next, laser exposing is performed by a laser exposing unit 12 according to an image pattern for yellow color to form an electrostatic latent image. The electrostatic latent image is developed by a yellow developing unit 3, and the yellow toner image is transferred to the intermediate transfer drum 2. After transferring, the photosensitive belt 1 is discharged by an eraser and cleaned by a cleaning unit 13. The cleaning unit 13 has a disposed toner collecting box 14 in which disposed toner produced by cleaning is collected. Then, after charged again, laser exposing is performed according to an image pattern for magenta color and the electrostatic latent image is developed by a magenta developing unit 4. The magenta toner image is transferred to the intermediate transfer drum 2 to be superposed on the yellow toner image previously transferred.

The process is sequentially performed to form an image for cyan color by a cyan developing unit 5 and to form an image for black color by a black developing unit 6, an image composed of four colors of yellow, magenta, cyan and black is formed on the intermediate transfer drum 2. During forming these images, a transfer mechanism composed of a cleaning unit 19, a transfer roller 17 and a discharging unit 18 provided around the intermediate transfer drum 2 does not contact to each other and are in a stand-by condition. Then, a sheet of paper is picked from a paper tray 21 to be electrostatically transferred the four color image on the intermediate transfer drum 2 together. The paper after being transferred is discharged to be peeled off by the discharging unit 18, and the toner of each color is heated by a fixing unit 20 to be melt-mixed and melt-fixed on the paper. Thus, the full-color printing is completed. After completion of transfer to a paper, the intermediate transfer drum 2 is cleaned to remove the remaining toner by the cleaning unit 19 for intermediate transfer drum. The disposed toner produced by the cleaning unit 19 is collected into the disposed toner collecting box 14 in the cleaning unit 13.

The developing units 3, 4, 5, 6 have toner supplying parts 7, 8, 9, 10, respectively, to supply the necessary amount of toner when the developing units lack in toner. In the embodiment, the photosensitive belt 1 is vertically arranged as shown in FIG.1, and the developing units 3 to 6 are vertically arranged along one side of the photosensitive belt 1. In the side reverse to the side arranging the developing units 3 to 6, the intermediate transfer drum 2, the cleaning unit 13 for photosensitive belt, the charging unit 11 and the laser exposing unit 12 are arranged in that order from bottom side. Further, under the developing units 3 to 6 and the intermediate transfer drum 2, the paper tray 21, paper transporting systems 15, 17 and the fixing unit 20 are arranged.

In a case of available paper sizes of A4 size to A3 size, the dimension of the apparatus with the above arrangement is the total apparatus height of 250 mm to 500 mm including the paper cassette height of approximately 40 mm, the depth of 290 mm to 400 mm when the paper discharging side for printing papers is in the front, and the width of 350 mm to 600 mm considering the space to mount a controller, a motor and so on. Accordingly, the apparatus according to the present invention has a size small enough to set it on a table.

Construction of each of parts composing the apparatus will be described below.

In order to construct a color image printing apparatus of a type utilizing electro-photographic process such as laser printer, it is common to employ a method where by providing photosensitive body for each color, transferring and fixing on a printing paper after completion of each process of charging, exposing and developing. This method has a disadvantage in that the size of apparatus becomes large because photosensitive bodies and exposing units for four colors are required. There is another method where by using one photosensitive body, printing process of charging, exposing, developing for each color is repeated three to four times to form an image by superposing images of basic colors of yellow, magenta, cyan (black is used in a case of four colors), and then the image formed is transferred and fixed on a printing paper. There are further methods where the basic process is composed of up to transferring to a printing paper and a full-color image is formed by superposing image of each color on the printing paper and fixing it, and where after developing an image of one color, as similar to the present invention, the image is transferred to an intermediate transfer drum to superpose images on the intermediate transfer drum, and then after completion of superposing the image is transferred and fixed on a printing paper. Each of the methods has its merits and demerits. Particularly, the method using an intermediate transfer drum is superior in obtaining a high quality color image because it is hardly affected by kinds of printing papers and/or change in the environment (especially, printing papers are apt to be affected by change in the environment).

Description will be made regarding the apparatus below.

The electro-photographic process according to the present invention requires various printing and transferring processes such as charging process for a photosensitive belt of a photoconductive material, exposing process, developing process, transferring process, cleaning process and fixing process. Accordingly, there is an disadvantage in that the size of the apparatus becomes large. In order to eliminate this disadvantage, according to the present invention, small-size and high speed printing are realized by minimizing the size of unit for each process and improving structural arrangement of each unit.

The embodiment according to the present invention shown in FIG. 1 has a construction of four-rotation type photosensitive belt, and a printing speed of 5 pages (A4 size printing paper) per minute for full color image printing and 20 pages per minute for mono-color printing. However, it is possible to increase the printing speed further with this construction. That is, the printing speed for mono-color by the construction shown in FIG. 1 is very high, from several ten pages per minute to several hundred pages per minute. Therefore, the apparatus has a high printing speed enough to attain speed of several pages per minute to several ten pages per minute for full-color printing even if the photosensitive body is rotated 3 to 4 cycles for color printing. This speed is faster than the speed in a color image printing apparatus of other type such as ink-jet type or thermosensible type, and is sufficient as a printing speed for a small-size color image printing apparatus of disk-top use.

A color image has a lager amount of information than a mono-color image. Since a color image printing apparatus is required high image quality, required printing density seems to be more than 400 to 600 dpi (unit indicating number of dots per one inch). In a case of a paper size of A4 and 400 dpi, the number of dots becomes approximately 15,500,000. With taking tone of 3 colors, 8 bits into consideration, the amount of information becomes 46M Byte. Thereby, in a present color printer, it takes several minutes to several ten minutes to convert and transmit data for image printing. Although the attempt will be made to lessen the conversion and transmission time in the future, it is sufficient that the printing speed of a color image printing apparatus is several pages per minute to several ten pages per minute as described above unless the conversion and transmission speed is improved by several hundred times to several thousand times as fast as present speed. Also from this point of view, it is effective for a small-size color photo-graphic apparatus of desk top type to employ the method where a single photosensitive body is rotated plural cycles. The details regarding printing speed will be described later.

As for method of superposing each of basic color images, in the present invention as described above, after completion of forming a toner image of one color on the photosensitive belt 1 the toner image is transferred on the intermediate transfer drum 2, and a toner image of the next color is formed on the photosensitive belt 1 and the toner image formed is sequentially transferred and superposed on the same intermediate transfer drum 2, and then after completion of superposing toner images of all colors on the intermediate transfer drum 2 the toner image is transferred and fixed to a sheet of printing paper.

As for the shapes of the photosensitive medium and the intermediate transfer medium, a construction using a belt and a construction using a drum can be considered. Since the shape of belt can be freely selected, there is an advantage in that the belt has a very small limitation against various printing and transferring process units arranged around it. However, the belt is apt to cause a snaking movement during driven, requires a mechanism such as tensioner for always applying a certain tension to the belt, and is apt to cause a slip during driven. Therefore, it is required to provide protuberances in the both edge portions of the belt, and to select materials for the driving shaft and for the inside surface of the belt such as to get sufficient frictional drive. On the other hand, when the photosensitive body is formed in a drum, it is simple in construction and easy in drive. However, there is a disadvantage in that the belt has a large limitation against various printing and transferring process units arranged around it.

Around the photosensitive body it is required to arrange a charging unit, an exposing unit, a cleaner, an eraser, an intermediate transfer drum as well as four developing units. In a case where both of the intermediate transfer medium and the photosensitive medium are formed in drums, it is required to make the drum diameter of the photosensitive body medium. In order to avoid this, there is a method where number of developing units attaching to the photosensitive medium is limited to one at a time and the developing units are exchanged according to color of printing using a sliding mechanism or a rotating mechanism. However, the exchanging mechanism is necessary and consequently it is inevitable that the apparatus becomes large. In a case where plural fixed developing units are arranged around the drum, the developing unit should be made so as to have a different construction from one other. From the viewpoint of decreasing production cost and simplifying construction, it is preferable that the three or four developing units used have the same construction. Therewith, it is important for a small-size color electro-photographic printer to employ a construction where the photosensitive medium is formed in belt-shape and developing units having the same construction are arranged in parallel.

Description will be made on the intermediate transfer medium below.

Among the process units arranged around the intermediate transfer medium there are not plural units having the same construction as the process units (developing units in case of the photosensitive medium) around the photosensitive medium. The number of process units around the intermediate transfer medium is less than the number of process units around the photosensitive medium. Further, when the photosensitive medium is formed in a belt-shape as described above, it is preferable to form the intermediate transfer medium in a drum-shape of which the construction and the driving are more stable and simpler than a belt-shape. Therefore, in the present invention, the construction of combination of an intermediate transfer drum 2 and a photosensitive belt 1 is employed.

In order to make a color electro-photographic apparatus small, it is necessary to make the intermediate transfer drum 2 and the photosensitive belt 1 small. In the type using the intermediate transfer drum as the present invention, the peripheral length of the drum must be longer than the length of the paper to be printed in the direction of transportation. When paper transportation is for a laterally oriented paper (shorter side direction) of A4 size, the required length of the periphery of the intermediate transfer body is longer than 210 mm. And when transportation is for a longitudinally oriented paper (longer side direction) of A4 size, the required length of the periphery of the intermediate transfer medium is longer than 297 mm. In a case of an apparatus capable of printing an A3 size paper, when transportation of a longitudinally oriented paper, the required length of the periphery of the intermediate transfer body is longer than 420mm. From the above results, in a case where the intermediate transfer medium is a drum, the diameter of the drum is larger than 67 mm (=210/3.14) in a case of transportation of a laterally oriented paper of A4 size, larger than 95 mm (=297/3.14) in a case of transportation of a longitudinally oriented paper of A4 size, and larger than 143 mm (=420/3.14) in a case of transportation of a laterally oriented paper of A3 size.

Figure 2:
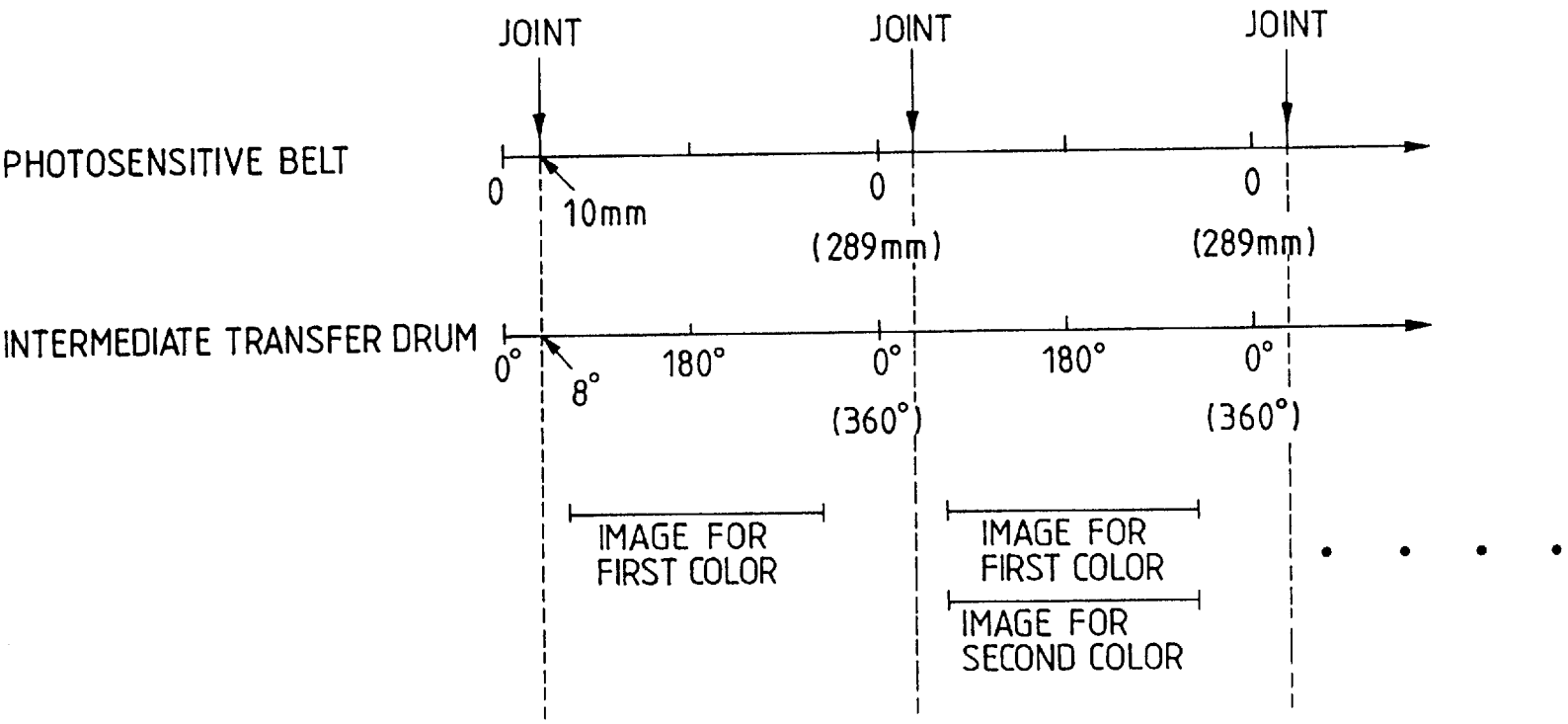
FIG. 2 is a view explaining the relationship between the outer peripheral length of an intermediate transfer body and the outer peripheral length of a photosensitive belt.
Figure 3:
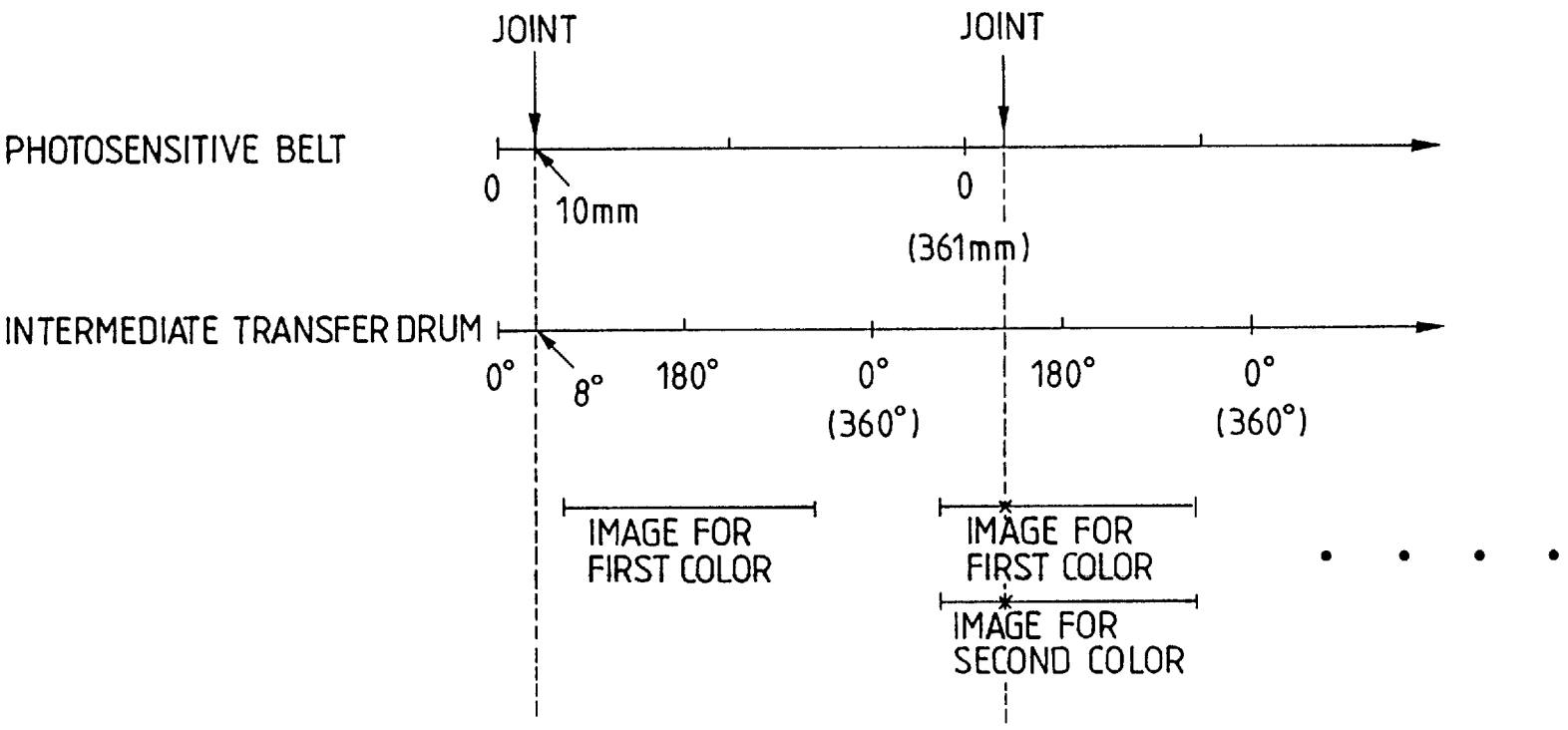
FIG. 3 is a view explaining the relationship between the outer peripheral length of an intermediate transfer body and the outer peripheral length of a photosensitive belt.

The photosensitive belt 1 has a joint because it is formed by bonding a photosensitive medium of a sheet-shape into a loop-shape. In order to print with avoiding the joint of the photosensitive belt, it is necessary that the position on the intermediate transfer drum 2 contacting with the joint of the photosensitive belt must be the same in every rotation of the photosensitive belt 1 as well as the peripheral length of the intermediate transfer drum 2 must be longer than the above calculated value by the joint region of the photosensitive belt. Therefore, it is necessary that the photosensitive belt 1 has a length of integral times as long as the peripheral length of the intermediate transfer drum 2. FIG. 2 is a diagram showing the positional relationship of the surface between the photosensitive belt and the intermediate transfer drum in the case where the rotating period of the intermediate transfer drum 2 and the rotating period of the photosensitive belt 1 are the same (in a case of one time). In FIG. 2, with letting the joint position of the photosensitive belt be position of 0 (zero) degree, by taking ±10mm as the joint region it is possible to make the image of each color agreeing with one another without overlapping with the joint portion. FIG. 3 shows in a case where the length of the photosensitive belt 1 is longer than the peripheral length of the intermediate transfer drum 2. As shown in the figure, when an image for a second color is tried to be superposed on an image for a first color having been transferred to the intermediate transfer drum, the image for the second color has to be formed on the joint portion of the photosensitive belt and accordingly a clear image cannot be obtained. In order to avoid the above trouble by agreeing the image forming position on the photosensitive belt 1 with the same position, it is required to individually control the rotations of the photosensitive belt 1 and the intermediate transfer drum 2 and to transfer an image after positioning properly by changing the rotating speed of the intermediate transfer drum 2. This is not suitable for a small-size apparatus because of complexity in construction and control.

Although it is possible to make a photosensitive belt seamless by applying photosensitive material to a joint portion, the photosensitive material on the joint portion is apt to be deteriorated by large number of rotations. Therefore, it is preferable to use a photosensitive belt in transferring toner images with avoiding the joint portion. That is, the length of the photosensitive belt 1 is preferably integral times as long as the peripheral length of the intermediate transfer drum 2.

Even in a case of using a seamless photosensitive belt in which deterioration does not occurs in the joint portion, shifting occurs between the rotating periods of the photosensitive belt 1 and the intermediate transfer drum 2 unless the length of the photosensitive belt 1 is integral times as long as the peripheral length of the intermediate transfer drum 2. It is necessary to control for positioning when superposing a toner image of each color, and it is known that the accuracy in the positioning is low.

In a case where the length of the photosensitive belt 1 is not integral times as long as the peripheral length of the intermediate transfer drum 2, when a flaw or a deteriorated part takes place on the surface of the photosensitive belt, the flaw or the deteriorated part appears in different positions every colors because shifting occurs between the rotating periods of the photosensitive belt 1 and the intermediate transfer drum 2. Therefore, the number of positions affected by the flaws and the deteriorated portions in a final toner image becomes large comparing to a toner image in a case where the length of the photosensitive belt 1 is integral times as long as the peripheral length of the intermediate transfer drum 2. In a case where the length of the photosensitive belt 1 is integral times as long as the peripheral length of the intermediate transfer drum 2, even when the photosensitive belt has a part deteriorated in its characteristic on the surface, the deteriorated part shows only an abnormal density region since the abnormal density regions in every colors due to the deteriorated part appear in the same position in the toner image. However, there is a disadvantage in that the color tone of the toner image changes when the toner image of each color displaces. From this reason, it is preferable that the length of the photosensitive belt 1 is integral times as long as the peripheral length of the intermediate transfer drum 2.

Accordingly, the diameter of the intermediate transfer drum 2 for performing A4 size paper printing is preferably approximately 70 mm to 120 mm, and the diameter for performing A3 size paper printing is preferably approximately 150 mm. Taking the peripheral length of the photosensitive belt 1 one time of the peripheral length of the intermediate transfer drum 2, the length of the photosensitive belt 1 for performing A4 size paper printing becomes approximately 220 mm to 380 mm, and the length for performing A3 size paper printing becomes approximately 470 mm. Taking the peripheral length of the photosensitive belt 1 two times as long as the peripheral length of the intermediate transfer drum 2, the length of the photosensitive belt 1 for performing A4 size paper printing becomes approximately 440 mm to 760 mm, and the length for performing A3 size paper printing becomes approximately 940mm. As described above, in a case of taking the peripheral length of the photosensitive belt 1 two times as long as the peripheral length of the intermediate transfer drum 2, the photosensitive belt 1 is required to have a substantially long length. Thereby, in order to realize a small-size color electrophotographic apparatus, it is important that the peripheral length of the photosensitive belt 1 is equal to the peripheral length of the intermediate transfer drum 2.

Figure 4:
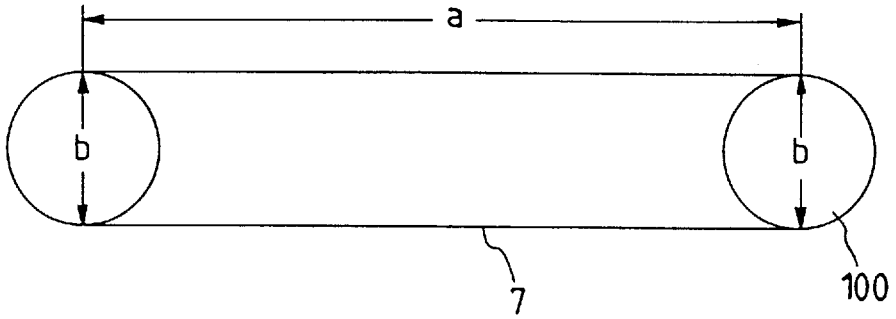
FIG. 4 is a view explaining the dimensions of various parts when a photosensitive belt is stretched over rollers.

When the diameter of the roller 100 for stretching over the photosensitive belt 1 is too small, the deterioration of the photosensitive belt is accelerated. Therefore, the diameter b of the roller 100 is required to be at least 10 mm to 20 mm or more. In a case where the photosensitive belt 1 is stretched over two rollers 100 having diameter of 200 mm as shown in FIG. 4, the length a of the straight portion in the photosensitive belt 1 becomes approximately 78 mm to 160 mm in one side (in a case of A4 size printing paper) and approximately 200 mm (in a case of A3 size printing paper).

In a case of arranging four developing units 3 to 6 of the type in one side of the photosensitive belt 1, the width of the one developing unit is required to be approximately 25mm to 50 mm at maximum. The width for A3 size paper becomes approximately 65 mm or less. With considering the gaps between the developing units each, it is clear that the developing unit having very thin width is required.

As for the arrangement of the developing units 3 to 6 to the photosensitive belt 1, it may be considered to arrange them under or above the photosensitive belt 1 other than arranging them beside the belt as shown in FIG. 1.

In a developing unit using two-component developing method, the developing agent composed of toner and carrier has to be recirculated between a mixing chamber for charging the developing agent and a developing roll. Therefore, in a case where the developing units are arranged above or under the photosensitive belt, it is required to provide a mechanism to transport the developing agent upward against the gravity when the developing agent is fed to or collected from the roll.

For example, in a developing unit arranged above the photosensitive belt 1, it is comparatively easy to feed the toner from a toner chamber to a mixing chamber and to transfer the developing agent from the mixing chamber to the developing roll because they are performed in the direction to the gravity. However, removing of the developing agent from the developing roll and transporting of the developing agent to the mixing chamber is performed in the direction against the gravity. Therefore, it is difficult to collect the developing agent removed from the developing roll with a blade on the developing roll into the mixing chamber, and consequently the toner is accumulated in a particular position inside the developing unit.

In this reason, the construction of a conventional developing unit is as follows. Toner on a developing roll is transferred to a magnet roll placed above, and transported once above then separated by a blade to returned into a mixing chamber provided in the side surface of the developing roll, therefore, in this construction, since the thickness of the developing unit becomes thick, it is difficult to form the thickness of this developing unit within the thickness of the developing unit described above.

On the other hand, in the arranging method shown in FIG. 1, there is no need to provide a construction for transporting developing agent or toner upward against the gravity. Therefore, it is possible to return the developing agent not having been consumed in the photosensitive body to a mixing chamber 34 by scraping the developing agent from a developing roll 31 with a blade 33 as well as to transport the developing agent to the developing roll 31 with a mixing paddle (mixing roll) 32. In a case where plural mixing rolls 34 are arranged in order to mix the developing agent well, the mixing rolls may be arranged in parallel to one another without increasing the thickness of the developing units, which is different from the case where the developing units are arranged above or under the developing roll. Further, the toner can be comparatively easily supplied from the side surface to the mixing chamber 34.

Figure 5:
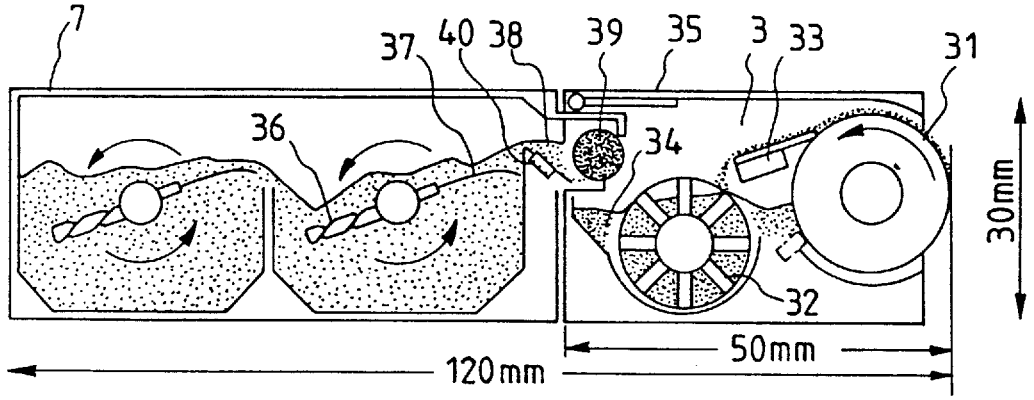
FIG. 5 is a view explaining the connecting state between a toner containing chamber and the main body of a developing apparatus.

In FIG. 5, the diameter of the developing roll 31 is 20mm, and the total thickness of the developing units is 30 mm. The mixing chamber 34 is arranged under and beside the developing roll 31 and toner is supplied to the under side of the developing roll 31. The toner on the developing roll 31 after developing is scraped with the blade 33 to be returned to the mixing chamber 34. In the construction of one embodiment of the apparatus in FIG.1 according to the present invention, the developing units 3 to 6 and the photosensitive belt are formed in a unit and the toner containing chambers 7 to 10 are formed in another unit in order to keep a gap accuracy between the developing units 3 to 6 and the photosensitive belt 1, to make handling of the developing units and the photosensitive belt 1 easy and to make supplying toner easy. In the embodiment of the developing unit 3 in FIG. 5, a connecting portion for connecting to a toner containing chamber unit 7 is provided on the side surface of the mixing chamber. The connecting portion has a cover 35 opening toward the inside of the container to be connected easily and to prevent toner from spilling before and at connecting time.

FIG. 5 shows the construction of the toner containing chamber unit 7 to be connected and the connected state to the developing unit 3. In the toner containing chamber, a rotating wing 37 formed of a PET (polyethylene terephthalate) film or the like having thickness of approximately 100$\mu$m is provided. The toner is transported to the developing unit side by rotating the rotating wing 37. In order to prevent the toner from sticking inside the toner case, a metallic comb-shaped rotating body 36 is provided in the reverse side of the rotating wing. In order to contain a large amount of toner in the thin space, in the embodiment shown in the figure, two toner chambers having the rotating wing 37 formed of a PET film and the comb-shaped rotating body 36 are arranged in series. In the supplying port of toner to the developing unit 3, there are a groove 38 storing toner and an exit gate formed of a foamed roller 39. The toner stored in the groove in the exit portion with the rotating wing 39 is transported into the mixing chamber 34 inside the developing unit 3 by rotation of the foamed roller 39. The rotation of the foamed roller 39 is controlled for supplying toner so that the output signal from a toner density sensor (not shown) inside the mixing chamber of the developing unit becomes a pre-set value. The control is performed by a controller in the main body side of the color image printing apparatus shown in FIG. 1. Lacking of toner in the toner containing chamber is detected by a toner sensor 40 provided near the foamed roller in the toner exit port. A controller (not shown) in the main body of the color image printing apparatus judges lacking of toner and generate a toner lacking signal to request an operator to supply toner.

The volume of the toner containing chamber unit 7 may be required to be large enough to print at least 1,000 sheets of color images having image density of approximately 10% each color with taking the frequency of toner supplying into consideration. The area of an A4 size paper is 623.7 $cm^2$(= 21cm×29.7cm), and the toner amount required for sufficient density is commonly approximately 1 $mg/cm^2$. The consuming amount of toner per one sheet of A4 size paper becomes approximately 0.06g/sheet for each color. Thereby, in order to print 1,000 sheets, the amount of approximately 60g toner is required. Since the density of toner loaded is approximately 0.3 to 0.4 $g/cm^3$, the volume of the toner is approximately 150 to 200 $cm^3$ (=60/0.3~0.4). With considering stable transportation of toner and prevention of toner sticking inside the toner containing chamber, the volume for the toner containing chamber is generally required approximately two to three times as large as the calculated volume. Therefore, the toner containing chamber is required to have a volume of approximately 300 to 600 $cm^3$. In the toner containing unit 7 in the embodiment shown in FIG. 1, assuming the height inside the toner containing chamber is approximately 2.5 cm, and the width in the direction of the developing roll shaft is approximately 28 cm, the width in the direction perpendicular to the developing roll shaft becomes 4.3 to 8.5 cm. The toner containing chamber unit 7 in the embodiment shown in FIG. 1 and FIG. 5 is 70 mm wide, and the total width of the developing unit is 120 mm.

In general, the size of a developing unit of non-magnetic one-component developing type can be made small comparing to that of a developing unit of two-component developing type. The developing unit of non-magnetic one-component developing type has no mixing chamber since the developing agent is charged with a blade or the like. Thereby, the developing unit can be comparatively easily arranged above the photosensitive belt 1. However, in the construction where the developing unit is arranged above the photosensitive belt independently of one-component developing type or two-component developing type, it is not preferable since the developing agent is apt to spill in the side of the photosensitive belt. On the other hand, in the construction where the developing unit is arranged under the photosensitive belt, it is difficult to construct this type since toner has to be transported against the gravity to supply toner to the developing roll even in non-magnetic one-component developing type. Further, in the developing unit arranged under the photosensitive belt, there is a possibility that the toner on the photosensitive belt falls in the developing unit for other color to be mixed. From the viewpoint, in the construction where multi-color printing is performed by rotating the photosensitive belt in plural cycles and by sequentially switching the developing units, it is effective to employ the construction where the developing units are arranged beside the photosensitive belt as shown in FIG. 1.

Figure 6:
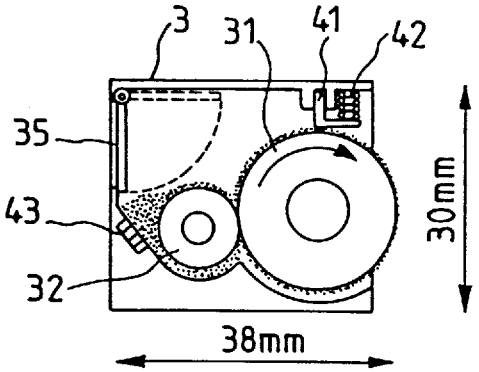
FIG. 6 is a view showing the construction of a nonmagnetic one-component developing apparatus mountable in the color image forming apparatus in FIG. 1.

FIG. 6 shows the construction of a non-magnetic one-component developing unit which can be mounted in the embodiment of a color image forming apparatus. A restricting blade 41 formed of an elastic blade is provided on the top surface of a metallic developing roll 31. There is provided a mixing roll 32 for supplying toner to the developing roll 31 in the back of the developing roll 31. There is a connecting portion for connecting to the toner containing unit in the upper side of the mixing roll 32. The same type unit as the aforementioned toner containing unit 7 shown in FIG.5 can be used as a toner containing unit. Decrease in the amount of toner is detected by the output from a toner sensor provided in a part of the wall surface contacting to the mixing roll 32 inside the developing unit 3, and toner is supplied from the toner containing unit 7. In the embodiment shown in FIG. 6, the width of the developing unit in the direction perpendicular to the developing shaft is approximately 40 mm.

Figure 7:
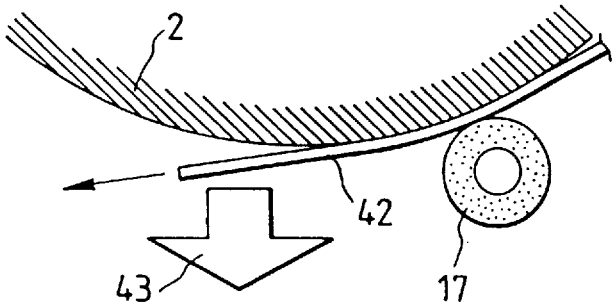
FIG. 7 is a view explaining the direction of gravity in a transfer portion.

In a case where four developing units (3 to 6) having thickness of approximately 30 to 40 mm are arranged in the straight region of on side of the photosensitive belt 1 stretched vertically, other printing and transferring process units of a charging unit 11, a laser exposing unit 12, a photosensitive body cleaner 13, an erase lamp 325 and an intermediate transfer drum 2 have to be arranged in the other side of the photosensitive belt 1. It is necessary to provide an intermediate transfer body cleaner 19 and an image transfer roller 17 for printing paper to the intermediate transfer drum 2. FIG. 7 shows a part for transfer an image from the intermediate transfer drum 2 to paper. In the figure, the transfer roller 17 is placed under the intermediate transfer drum 2, and when the printing paper 42 is passed through between them a toner image is transferred to the printing paper 42. Since it is difficult for a small-size apparatus to provide a mechanism for peeling the printing paper upward by sucking method or the like, it is preferable that the gravity acts on the paper in the direction of peeling as shown by the arrow 43 in FIG. 7 for peeling the paper after transferring. From this viewpoint, it is preferable that transferring from the intermediate drum to paper and position of peeling a printed paper are performed from the bottom side of the intermediate transfer drum 2.

From the reasons described above, in the embodiment of the apparatus according to the present invention shown in FIG. 1, the length of the straight portion of the photosensitive belt in the developing unit side is set to 100mm, and the diameters of the inner rollers 100 of the photosensitive belt 1 are set to 23 mm and 18.4 mm. The diameter of the intermediate transfer drum 1 is 92 mm. In order to make the rotating fluctuation period agreeing with that of the intermediate transfer drum, the diameters of the inner rollers 100 of the photosensitive belt 1 are set to one-fourth and one-fifth of 92 mm.

Further, from the reasons described above, in the embodiment of the apparatus according to the present invention shown in FIG. 1, the photosensitive belt 1 is developed from the side, the photosensitive belt 1 being arranged above and in one side of the intermediate transfer drum 2 with being vertically stretched long because of necessity to arrange the transferring image to paper and peeling means under the intermediate transfer drum 2, the transferring and peeling means being arranged under the intermediate transfer drum 2.

Figure 8:
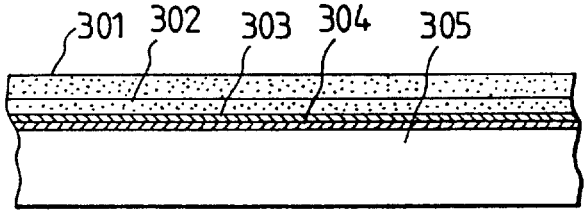
FIG. 8 is a view explaining the details of a photosensitive belt portion.

FIG. 8 is a view showing the detailed construction of an embodiment of a photosensitive belt 1 according to the present invention shown in FIG. 1. The photosensitive belt 1 is formed by vapor-depositing aluminum on a PET film 305 (polyethylene terephthalate film) having thickness of 150 $\mu$m and applying a photosensitive material on it. The photosensitive belt has an aluminum vapor-deposited layer 304 on a PET film having thickness of 150 $\mu$m, above the layer an insulator layer 303 for holding withstanding voltage during non-exposing time of photosensitive body, and further a negative chargeable organic photosensitive body composed of a charge generating layer 302 and a charge transferring layer 301 applied on it. Since the layer thickness of the portion of the photosensitive body 306 is approximately 20 $\mu$m, the total thickness of the photosensitive belt 1 becomes approximately 170 $\mu$m. Strictly speaking, the diameters of 23 mm and 18.4 mm of the inner rollers 100 in the photosensitive belt 1 described above are formed smaller by this belt thickness.

In the edge portions in the width direction, there are provided protrusions made of a rubber material having a width of approximately 1.5 mm and a thickness of approximately 0.5mm. The inner rollers 100 inside the photosensitive belt 1 are formed to have taper portions in the both edge portions to prevent the photosensitive belt 1 from snaking with the protrusions of the photosensitive belt and the taper portions of the inner rollers 100 inside the photosensitive belt 1.

Figure 9:
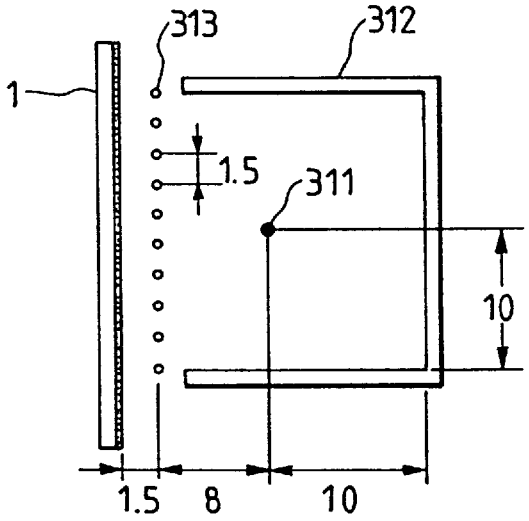
FIG. 9 is a view explaining the details of the construction of a charging unit.

FIG. 9 is a view explaining the detailed construction of an embodiment of a charging unit according to the present invention shown in FIG. 1. The charging unit is a scorotron charger having a discharge wire 311, a shielding case 312 and a grid wire 313. A tungsten wire plated with gold is used as the discharge wire 311 not to be deteriorated by discharge. The diameter of the discharge wire is moderate to handle easily, not too thin and not too thick. The discharge wire in the embodiment is a tungsten wire of diameter 60 $\mu$m with gold plating of thickness 3 $\mu$m. In general, the diameter of the discharge wire is preferably 40 to 100 $\mu$m. When the distance between the shielding case 312 and the discharge wire 311 is small, abnormal discharge is apt to take place due to vibration during discharge. When the distance is large, the discharge voltage becomes high. A proper distance between the shielding case 312 and the discharge wire 311 is approximately 10 mm, and the total width of the discharge unit, therefore, becomes approximately 20 mm. As for the distance between the grid wire 313 and the surface of the photosensitive belt 1 and the pitch between the grid wires 313, it is known that there is a certain relationship in order to make effective charging characteristic and control characteristic compatible with each other. That is, it is proper that the pitch between the grid wires is equal to the gap between the photosensitive body and the grid. Therefore, in this embodiment, the pitch between the grid wires is set to 1.5 mm, and the gap between the photosensitive belt and the grid wire is set to 1.5 mm. The distance between the photosensitive belt and the discharge wire in this embodiment is approximately 8.5 mm. The voltage applied to the grid wire is set to 500V under the charged voltage of the photosensitive belt of 500V as a target voltage. Voltage applying means to the grid is easily constructed by employing high Zener diodes, but a negative variable voltage power source is required when the charged voltage of the photosensitive belt is necessary to be changed.

In this embodiment, the process speed (moving speed of the photosensitive body) is 95 mm/s, the printing paper used is A4 size, and the paper is transported in the direction parallel to its short side direction. The surface area of the photosensitive belt charged by the charging unit 11 every second is approximately 285 $cm^2$. The electrostatic capacitance of the organic photosensitive belt having thickness of 20 $\mu$m described above is approximately $2.0\times10^{-10}$ $F/cm^2$. The electrostatic capacitance of the surface area of the photosensitive belt to be charged in a second is $5.7\times10^{-8}$ F, and the charged voltage on the surface of the photosensitive belt is assumed to be 500 V. Then the required current to be supplied to the surface of the photosensitive belt is $2.85\times10^{-5}$ A, that is, 28.5 $\mu$A. In this charging unit of the construction, it is necessary to supply a large amount of current to the grid to stabilize the voltage in the surface of the photosensitive belt. With assuming that the grid current is approximately three times as much as the current required by the surface of the photosensitive belt, the amount of the current flowing to the surface of the photosensitive belt and the grid is approximately 120 $\mu$A. In the above construction, a current approximately three times as much as this amount of current flows to the shielding case 312. Therefore, the amount of the corona discharge current is approximately 500 $\mu$A. This value of current is within the range of being obtainable by applying a voltage of 5 to 7 kV to the single corona discharging wire 311 in the above construction. In the embodiment of the apparatus shown in FIG. 1, the value of the current is obtained by applying voltage of 5.8 kV.

A roller charging mechanism may be provided within the installed space of this charging unit.

Figure 10:
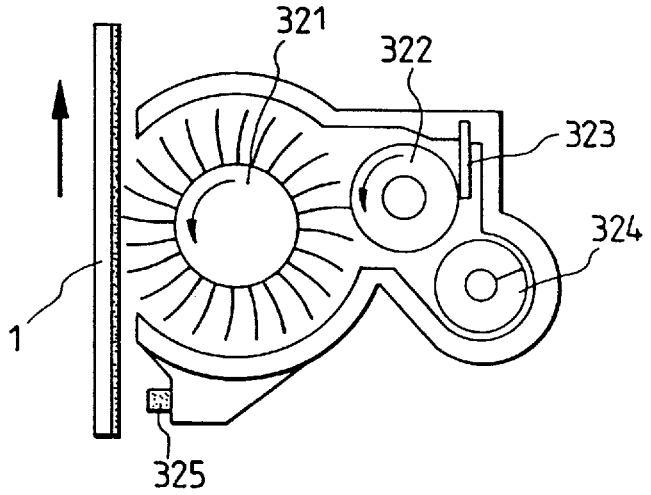
FIG. 10 is a view explaining the details of the construction of photosensitive body cleaner.

FIG. 10 shows the construction of a photosensitive belt cleaner 13 used in the embodiment according to the present invention in FIG. 1. Since the photosensitive belt 1 in the embodiment is arranged being stretched in the vertical direction, the photosensitive belt in the position of the cleaner moves in the vertical direction. As for another method of cleaning the photosensitive belt 1, there is one of the simplest constructions where an elastic blade is pushed against the belt. However, in the method of such type, the toner scraped off falls in the direction of the gravity. Therefore, when the cleaning method is used in the apparatus of this construction having vertical stretched photosensitive belt, there is a large possibility of leaking the toner out of the cleaner.

Therewith, the embodiment employs a brush cleaning method shown in FIG. 10. This method is that a conductive cleaning brush 321 rotating in the direction opposite to the moving direction of the photosensitive belt 1 the toner and scrape the toner and electrostatically attract the toner by applying a voltage higher than the voltage on the surface of the photosensitive belt 1 to the conductive cleaning brush 321. In the construction of the embodiment, a voltage of approximately 600 V is applied to the base aluminum layer 304 in the photosensitive belt 1 as a base voltage. Therefore, the cleaning brush 321 in the photosensitive body cleaner 13 is in the grounded voltage. The reason why the voltage of 600 V is applied to the base aluminum layer 304 in the photosensitive belt 1 as the base voltage will be described in detail later in connection with the construction of the intermediate transfer drum. The photosensitive belt cleaner 13 has a metallic roller 322 in the back of the cleaning brush 321, and is subjected with a positive voltage. Thereby, the toner scraped with the cleaning brush 321 is transferred to the metallic roller 322. A blade 323 is arranged to the metallic roller 322 to scrape down the attaching toner. The scraped toner is transported to the disposed toner collecting box 14 of FIG. 1 using a screw transporting mechanism 324. In the apparatus of the embodiment according to the present invention shown in FIG. 1, the diameter of the cleaning brush 321 is approximately 20 to 25 mm which is large enough to clean the photosensitive belt. The diameter of the metallic roller 322 placed behind is approximately 10 mm. Cleaning is easily performed if the surface of the photosensitive belt is sufficiently discharged before cleaning. Therefore, in this apparatus, under the cleaner there is provided a discharging mechanism utilizing an LED array which is incorporated with the cleaner to make handling and assembling easy.

Figure 11:
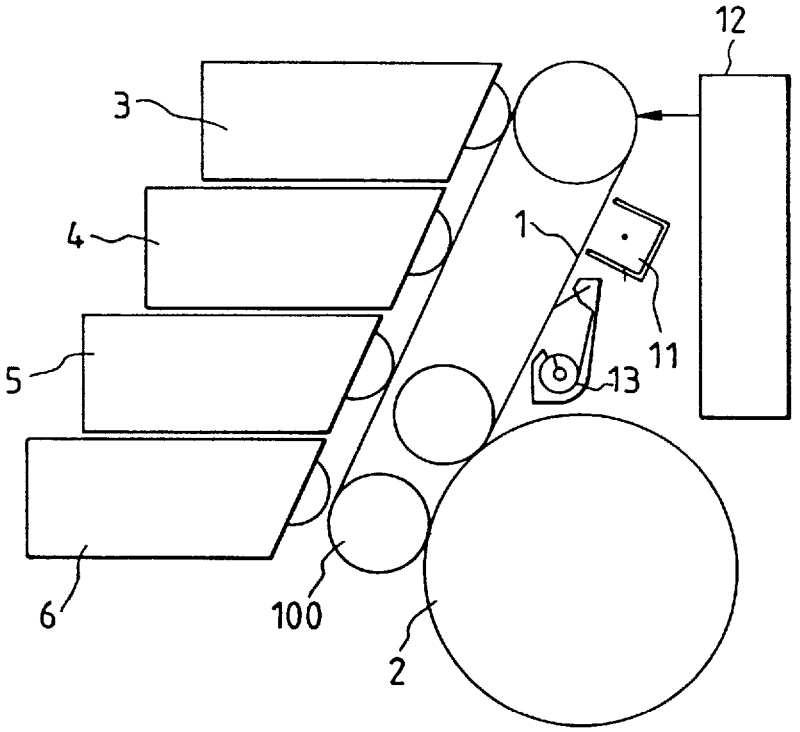
FIG. 11 is a view explaining the construction for tilting a photosensitive belt.

The brush cleaner 321 is used in the apparatus of the embodiment in FIG. 1 according to the present invention because the photosensitive belt 1 is stretched vertically. However, in a construction where the photosensitive belt is stretched tilting a little as shown in FIG. 11 to detach the toner scraped from the belt, a cleaner 13 having an elastic blade shown in the figure may be employed. The other like parts in the figure are identified by like numerals referred to like parts in FIG. 1. In this figure, the laser exposing unit 12 is arranged vertically in order to make effective use of space for aiming at small size.

The height of the charging unit 11 facing to the surface of the photosensitive belt is approximately 20 mm, and the height of the photosensitive belt cleaner unit 13 incorporated with the erase lamp 325 facing to the surface of the photosensitive belt is approximately 35 mm. When the intermediate transfer drum 2 is arranged in parallel to the center line of roller in the bottom side of the photosensitive belt 1, these units can be arranged beside the surface of the photosensitive belt in the side opposite to the side of the surface of the photosensitive belt beside which the developing units 3 to 6 are arranged.

The laser exposing unit 12 in the embodiment of FIG. 1 will be described in detail below. The exposing position of the laser exposing unit 12 will be described. In the photosensitive belt formed of the organic materials described above, more than 150 ms is generally required for the time from starting of exposure to forming a stable electrostatic latent image. Therefore, the time from exposing to developing is set to 300ms. If the position of the photosensitive belt is fluctuated in the exposing position on the photosensitive belt 1, a blur takes place in the exposing point due to fluctuation in the focus to degrade the resolution of the image. Thereby, exposure has to be performed in a position such as the position on the roller 100 inside the photosensitive belt where the behavior of the photosensitive belt is stable. In the embodiment, the developing unit 3 placed in the nearest position to the exposing position is arranged at the position where the photosensitive belt departs from the roller 100 inside the photosensitive belt. The photosensitive belt 1 wraps the roller 100 over the range of 180 degrees.

Since the diameter of the roller 100 is 23 mm, the length of being wrapped with the photosensitive belt 1 is approximately 36 mm. In order to perform exposure on the roller 100 in advance of developing by 300 ms, the process speed can be set 120 mm/s (=36mm/0.3s) at maximum. In this embodiment, the angle between the exposing position and the developing position is set to 150 degrees. In this case, the maximum allowable process speed is approximately 100 mm/s. In this embodiment, the process speed is set to 95 mm/s with taking allowance. As described above, the intermediate transfer drum 2 in the embodiment of FIG. 1 has the diameter of 92 mm, and then the peripheral length is approximately 289mm. Under condition of the process speed of 95 mm/s, the intermediate transfer drum 2 rotates approximately 19.7 cycles per minute. In the embodiment of the apparatus shown in FIG. 1 where a sheet of full-color image is printed with four rotations, printing speed of approximately 5 pages per minute is possible. This is a main reason that the embodiment of the color image printing apparatus has the process speed of 5pages per minute for full-color image printing (A4 size printing) and the process speed of 20 pages per minute for mono-color image printing. A higher printing speed may be possible in the embodiment of construction shown in FIG. 1 by changing the size of the apparatus. The printing speed is, as described above, is sufficient for a small-size full-color image printing apparatus of desk-top type.

Figure 12:
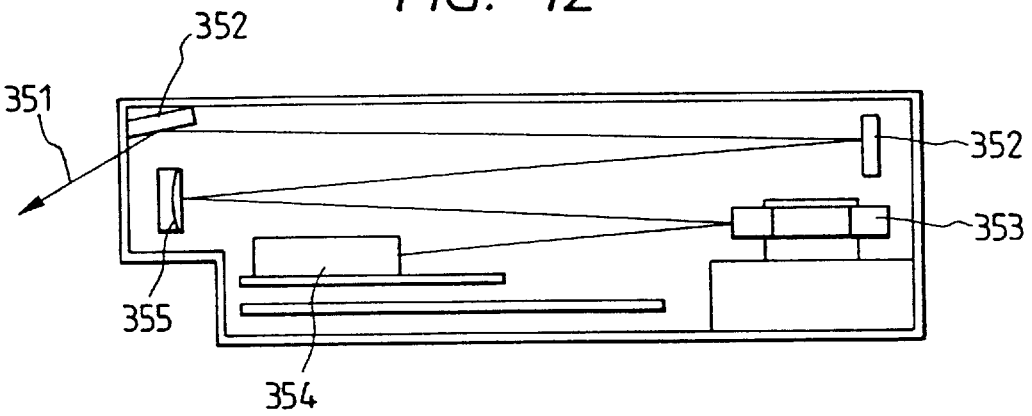
FIG. 12 is a view explaining the details of the construction of an exposing unit.
Figure 13:
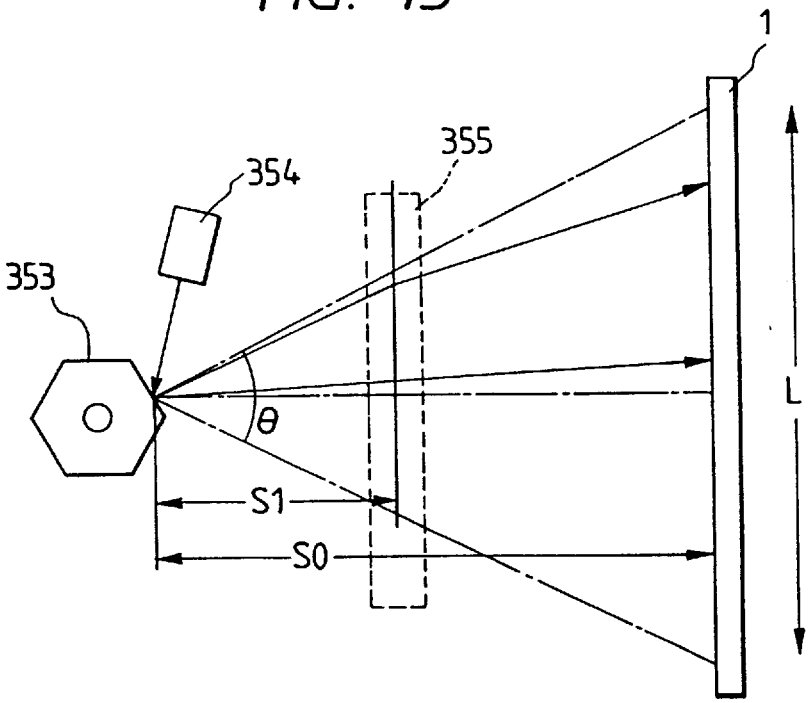
FIG. 13 is a view explaining the construction of a light scanning portion in a laser exposing unit.

FIG. 12 shows the detailed construction of an embodiment of an exposing unit 12 in the embodiment in FIG. 1 according to the present invention. The exposing unit in the embodiment according to the present invention employs a laser exposing apparatus 12 in order to perform a high resolution image printing. In FIG.12, a laser beam 351 released from a laser light source 345 is reflectively scanned with a polygon mirror 353, the light passing through an fθ lens 355 of reflection type, being reflected by two reflecting mirror 352, then being released toward the surface of the photosensitive belt which is not shown in this figure. FIG.13 is a view showing the construction of a scanning part in the laser exposing unit. A laser light beam 354 from a semiconductor is reflectively scanned with a polygon mirror 353, and the difference in the focal length due to the difference in light path up to the surface of the photosensitive belt 1 of the object to be exposed and the fluctuation in the displacing distance on the scanning surface per unit rotating angle of the polygon mirror 353 are corrected with an fθ lens 355 of transparent type. In order to obtain the width of printing image for the laser scanning width, it is necessary to keep a long light path length from the polygon mirror to the photosensitive belt. When the scanning angle of the polygon mirror is small, the amount of correction with the fθ lens becomes small and it is easy to obtain a stable quantity of exposing light in the scanning direction. However, when the scanning angle is small, the length from the polygon mirror to the photosensitive body becomes long and the whole size of the optical system becomes large. Therefore, the limitation of the scanning angle is nearly 100 degrees (50 degrees in one side). In a case of setting the scanning angle to 100 degrees, in order to scan about 300 mm of side length of an A4 size paper in the longitudinal direction, the required length from the polygon mirror to the photosensitive body is obtained from the following equation.

$$S_0 = \lim_{X_0 \to 0}\left(\frac{X_0}{\tan(\theta/L \cdot X_0)}\right)$$

Wherein, $S_0$ is required light path length, L is scanning length, θ is scanning angle, $X_o$ is distance from the center point of scanning. By inserting the above values into the equation and approaching $X_o$ to 0, $S_o$ becomes approximately 172 mm. In order to make the width of the fθ lens smaller than the width of the scanning surface of 300 mm under this condition, it is necessary to set the distance from the polygon mirror to the fθ lens less than the distance obtained from the following equation.

$$S_1 = \frac{1}{2} \cdot \frac{1}{\tan(\theta/2)} \tag{2}$$

By inserting scanning distance L=300 mm and scanning angle θ=100 degrees, $S_1$ becomes approximately 126 mm. Therefore, in this construction, it is necessary to place the fθ lens 355 in a position nearer than approximately 126 mm to the polygon mirror 353. As for the optical system unit used in the embodiment in FIG.1 according to the present invention, if the height of the optical system unit is larger than approximately 100 mm, the entire apparatus becomes large since the diameter of the intermediate transfer drum 2 is 92 mm. However, comparing to the allowable height of the optical system unit, the length of laser light path required in the laser exposing unit 12 obtained from the calculated result is considerably long.

Figure 14:
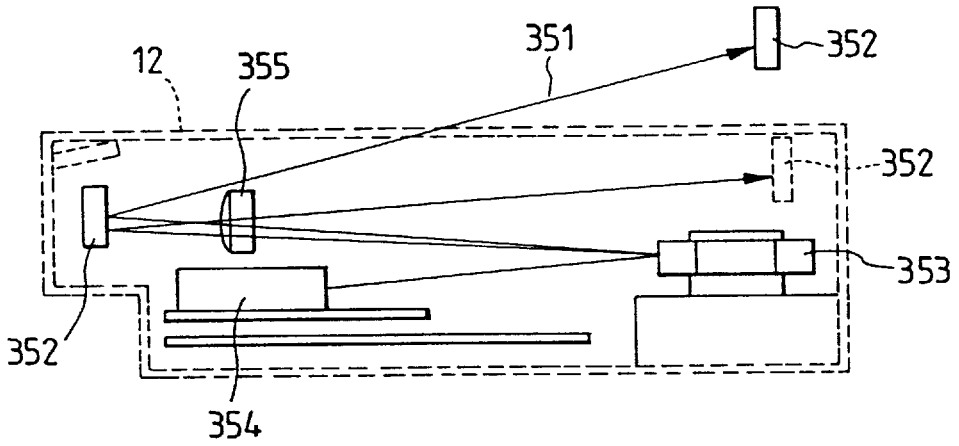
FIG. 14 is a view explaining the construction of an exposing portion when an fθ lens is used.

Therefore, in the embodiment shown in FIG.12, the light path after scanned is folded two times in the longitudinal direction of the laser exposing unit 12 using reflecting mirrors 352. In a construction where an fθ lens is inserted between the reflecting mirrors as shown in FIG. 14, it is necessary that the reflected light at first time after passing through the fθ lens does not pass through the fθ lens again. Thereby, since the reflecting angle of the first reflection is set to be large, the size of the laser unit in the thickness direction is increased. Therefore, in the construction of the embodiment shown in FIG. 12, the reflecting mirror for the first reflection is formed in a shape having the fθ characteristic. In this construction, since the reflecting angle from the reflecting mirror for the first reflection can be made small, the optical length can be kept long without increasing the size of the optical system unit in the thickness direction. The fθ mirror of such type can be easily fabricated by vapor-depositing aluminum or the like on a plastic molded member, and it is comparatively easy to fabricate mirrors of any shape (a free curved surface not limited to spherical, aspherical, symmetric, asymmetric) having various characteristics.

Figure 15:
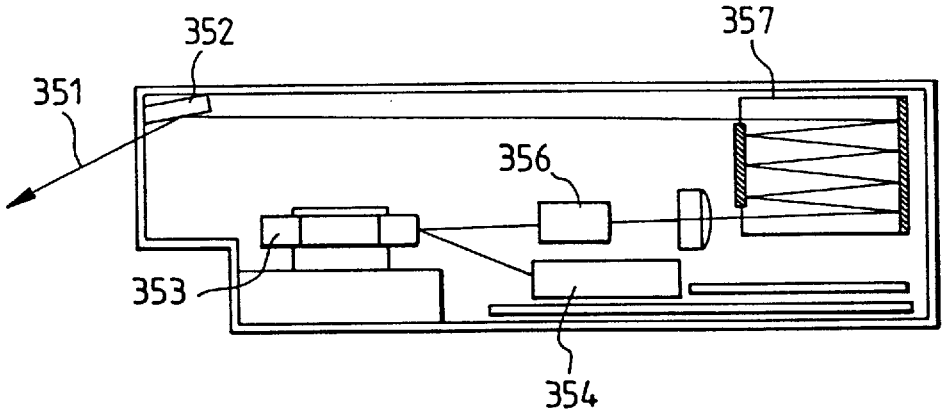
FIG. 15 is a view explaining another embodiment of the construction of an exposing unit.

FIG. 15 shows an embodiment of another construction of optical system. Behind the polygon mirror 353 there is a multi-reflection mirror 357 having mirrors placed in parallel to each other to reflect a laser beam turning back and forth inside the multi-folding mirror. The multi-reflection mirror is fabricated by vapor-depositing aluminum or the like on the surfaces of a plastic block or a glass block to form mirrors. Since a laser beam is turned back and forth plural times inside the multi-reflection mirror, a long light path can be obtained. In such a multi-reflection system, the incident angle to the mirror is different between the central portion of an image and the edge portions of the image, which causes the difference in attenuation of laser beam. In order to cope with this phenomenon, there is provided in the embodiment of FIG. 15 a polarization control means 356 for polarizing the laser beam before entering the multi-reflection system. The difference in the attenuation after passing through the multi-reflection mirror 357 can be corrected by the polarizing direction of the laser beam. There can be considered another method where the intensity of light generated by the laser light source 354 is controlled in synchronizing with the rotation of the polygon mirror 353 to correct the amount of attenuation of the laser beam 351 corresponding to the exposing position on the photosensitive body.

By employing the above means, the laser exposing unit 12 in the embodiment according to the present invention shown in FIG. 1 becomes approximately 100 mm wide and approximately 30mm high. As for the other methods to make the optical system small, it is possible to use an optical system of LED array or liquid crystal shutter. However, the laser exposing type is superior to others in definition and stability of exposing light intensity at the present time.

As for the developing units 3 to 6, the developing units are aligned in a line in the straight portion of the photosensitive belt as described above. These developing units have to be performed contact operation and stand-by operation one-by-one corresponding with each rotation of the photosensitive belt when a color image is formed. Further, in order to realize a stable high image quality developing in a two-component developing method, a high accuracy of 100 $\mu$m order is required in the gap between the developing roll and the developing unit during developing. In the construction of the embodiment, the four developing units and the photosensitive belt are incorporated in a unit in order to keep the gap between the photosensitive belt and the developing units in a high accuracy. Furthermore, in the embodiment, the toner cassettes are formed in separate units from the developing-unit/photosensitive belt unit in order to make toner supply easy by capability of independent supplying.

Figure 16:
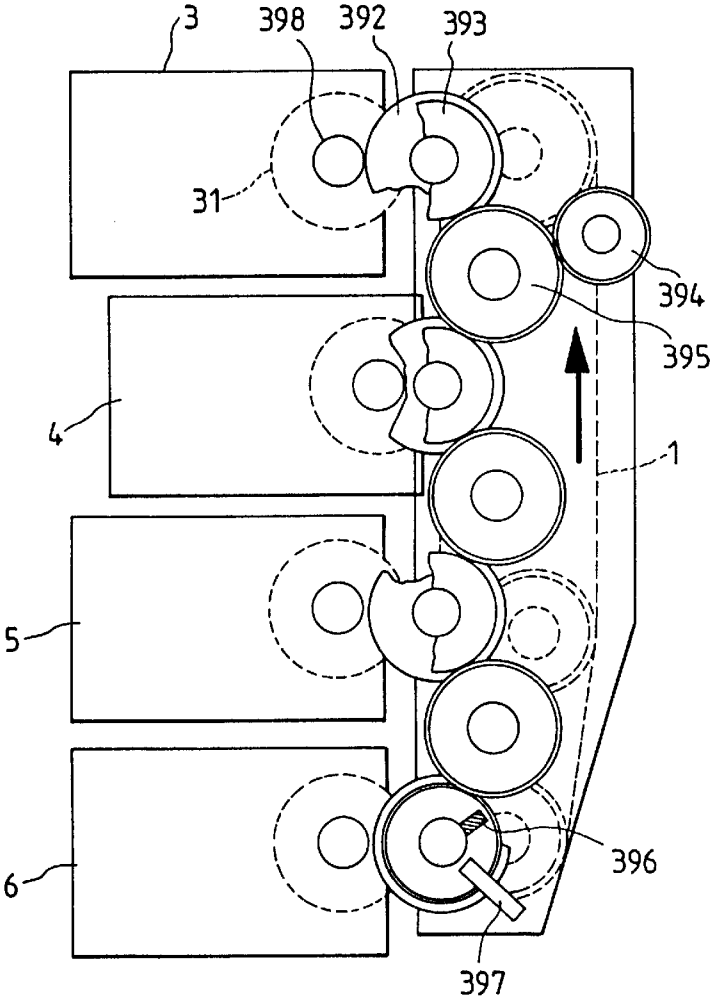
FIG. 16 is a view explaining the details of the constructions of a developing unit and an photosensitive body unit.

FIG. 16 shows the detail of an embodiment of a developing unit standby-contact mechanism in the developing-unit/photosensitive belt unit in the embodiment. The developing unit 3 has a developing roller 31 in a developing roller shaft 398 and a cam mechanism having cams with a notch in a part of the periphery is provided in the side of the photosensitive belt 1. The four cams 329 are linked with gears 393, 395 so that the four developing units are contacted with the photosensitive belt one-by-one by rotating the gears in the edge region by a given angle step-by-step using a driving mechanism in the image forming apparatus through a driving source connecting gear 394 when the developing units are mounted in the image forming apparatus. In FIG. 16, the gears placed on the cams are partially cut away to show the cams. The positional states of the developing units are basically four positional states where one of the developing units for four colors contact to the photosensitive belt and one positional state where all the developing units are in stand-by state in detaching from the photosensitive belt. During off-printing, the cam mechanism is set so that all the developing units are in stand-by state. And during printing, the cam mechanism is controlled in such that each of the developing units is sequentially contacts to the photosensitive belt one-by-one, a mark 396 is attached on a part of a linked gear in the developing-unit/photosensitive-belt unit to control the contact and stand-by state of each of the developing units using a developing-unit-standby-mechanism controller (not shown) in the main body of the image forming apparatus by identifying which developing unit contacts to the photosensitive belt through detecting the position of the mark using a sensor (photosensor or the like) 397 placed in the main body of the image forming apparatus.

Figure 17:
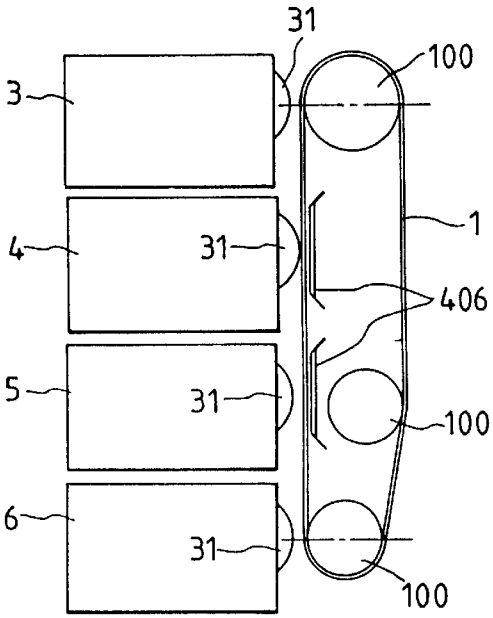
FIG. 17 is a view explaining the construction of a photosensitive body guide applied to a two-component developing apparatus.

In a two-component developing unit, the gap accuracy during printing is very important. In the construction of FIG. 17, since two developing units in the both side ends among the four are in the positions facing to the surface of the photosensitive belt in the position of the inner rollers 100, the behavior of the photosensitive belt in these positions are stable and the gaps are easily kept constant. However, the other two developing units are placed in the straight portion of the belt, and it is required to arrange guide members 406 as shown in FIG. 17. Although the guide member 406 in the figure is flat-shaped, it is possible to use rotating rollers 413 as shown in FIG. 18 as the guide members.

Description will be made below on the construction of contact and stand-by in a case of using a non-magnetic one-component developing unit as the developing unit. In the non-magnetic one-component development, there is no need to keep such a certain accuracy as in two-component development. However, since the development is preformed by contacting a toner layer having thickness of several ten $\mu$m formed on the developing roll 31 to the photosensitive belt the developing roll 31 and the photosensitive belt 1 have to be stably and perfectly contacted to each other. It is ideal that the photosensitive belt 1 and the developing roll 31 are in a contact state having a nip width. Therefore, some troubles will cause with the contact positions and the guide construction for two-component developing unit shown in FIG. 17.

Figure 18:
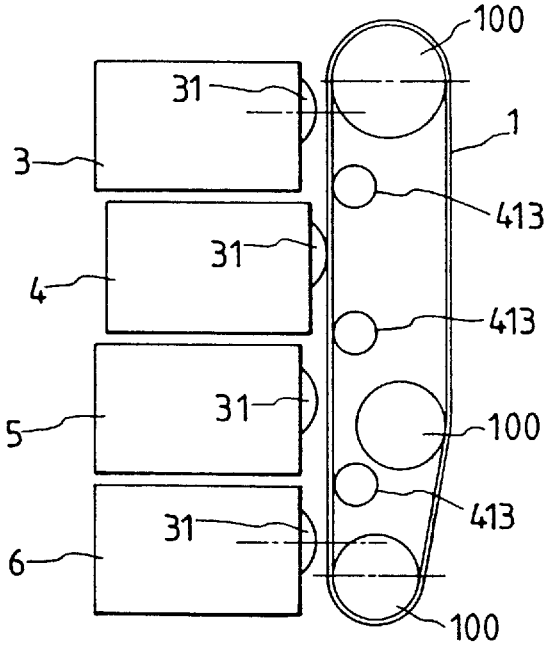
FIG. 18 is a view explaining the construction of a photosensitive body guide applied to a one-component developing apparatus.

FIG. 18 shows contact positions of the developing units and the construction of an embodiment of guide members of the photosensitive belt 1 when one-component developing units are used. The photosensitive belt 1 is necessary to contact to a developing roll 31 of the developing unit under preforming development with a nip. Therefore, the contact positions of the developing rolls 31 of the developing units at the both side ends are required to be positioned in the middle side from the inner rollers 100 inside the photosensitive belt. With arranging as above, the photosensitive belt 1 deflects along the developing roll 31 of the developing unit contacting to the photosensitive belt to easily keep a stable nip. As for the two developing units in the middle portion, a sufficient nip can be given by displacing two guide rollers 413 toward the developing units.

As for anther method, in a case of using the guide member 406 shown in FIG. 17, it is considered to form the guide member 406 in a concave shape or to place an elastic material on the surface. Further, it can be considered to form the developing roll itself with an elastic material to stably contact to the photosensitive belt with the deformation of the developing roll 31. However, the developing roll 31 is preferably made of a rigid material such as a metallic material with taking the life time of the developing roll 31 into consideration in the one-component developing unit which has many blade friction members.

In the one-component development, as described above, since the developing units cannot be placed just on the inner rollers 100 inside the photosensitive belt 1 in the both ends, the allowable height per one developing unit becomes a little small comparing to in the two-component developing unit. However, since the one-component developing unit does not require any mixing chamber and any magnet roller, the height generally does not become a large problem for decreasing its size comparing to the two-component developing unit.

The intermediate transfer drum 2 has a semiconductor layer or an insulator layer on the surface of a metallic roller. The surface is covered with an elastic material having thickness of several hundreds pm to several mm so as not to scratch the surface of the photosensitive belt during contact with the photosensitive belt 1. In the color image forming apparatus in FIG. 1, the intermediate transfer drum 2 is in the grounded voltage, and, in the other hand, the base voltage of the photosensitive belt 1 is approximately 500 V negative to electrostatically transfer an image of each color charged negative formed on the photosensitive belt 1. Further, a composite image of respective color images formed on the intermediate transfer drum 2 is transferred to a paper using the transfer roller 17 arranged under the intermediate transfer drum 2. The image transferring to a paper is electrostatically performed by applying positive voltage to the transfer roller 17.

In order to prevent the intermediate transfer drum 2 from being charged by the processing units arranged around the intermediate transfer drum 2, it is preferable that the surface insulator layer has a resistance smaller than a certain value. In the color image forming apparatus shown in FIG. 1, the process speed is set to 95 mm/s. Let the capacitance of the layer of the intermediate transfer drum be C ($F/cm^2$) and its resistance be R ($\Omega/cm^2$). The time required for the charge on the surface of the intermediate transfer drum to dissipate is approximately C×R seconds. If the value is less than 100 ms, the charge on the surface of the intermediate transfer drum is dissipated while the intermediate transfer drum 2 moves approximately 1 cm. However, when the intermediate transfer drum is conductive, discharge takes place at contacting with the photosensitive belt or in the contact position with the transfer roller 17. Therewith, a fault occurs in a printing image. With the reason described above, it is necessary to form the surface layer of the intermediate transfer drum 2 with a semiconductor material. In a case where a discharge mechanism for control charge on the surface of the intermediate transfer drum 2 is arranged around the intermediate transfer drum 2, it is possible that the resistance of the surface layer of the intermediate transfer drum 2 may be an insulator have a very high resistivity. As the discharge mechanism to control the charge can be used is a discharging mechanism having non-contact needle-shaped members, an AC corona discharger or a scorotron charger.

In the embodiment of the color image forming apparatus according to the present invention shown in FIG. 1, the mechanism for transfer a color image formed on the intermediate transfer drum 2 to paper employs a roller transfer method. The toner image composed of respective color images on the intermediate transfer drum 2 is different in its thickness depending on the positions of the image. In order to transfer the image completely and certainly, it is important that the intermediate transfer drum 2 is certainly and intimately contact with a paper of image receiving body. Therefore, a roller transfer method is employed in this embodiment. In a case where a paper is certainly and intimately contact to the intermediate transfer drum 2 using a paper guide or the like, a corona transfer method may be employed.

Figure 19:
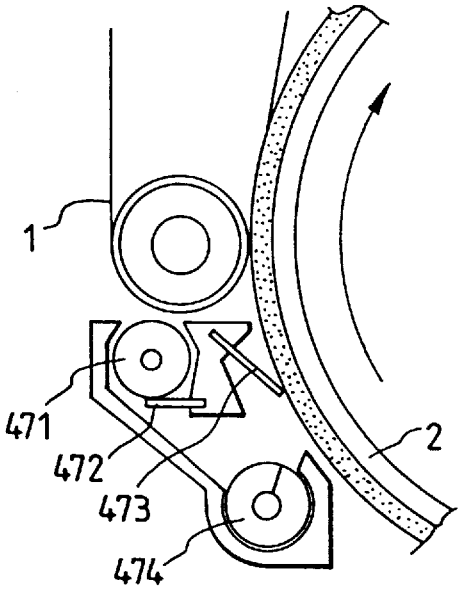
FIG. 19 is a view explaining another embodiment of an intermediate transfer body cleaner in accordance with the present invention.

In the embodiment of the color image forming apparatus according to the present invention shown in FIG.1, a blade cleaning method is employed in the cleaner for the intermediate transfer drum 2. FIG. 19 shows another embodiment of a cleaner for the intermediate transfer drum 19 used in the color image forming apparatus of FIG. 1. In the construction of this embodiment, a blade cleaning method using a blade cleaner 473 having a simple construction is employed since the position of the cleaner is under the side of the intermediate transfer drum 2. However, as described in connection with the photosensitive belt cleaner 13, if a cleaner is positioned in such a position that the toner cleaned off is fallen toward the surface of the intermediate transfer drum 2, it is preferable to employ a brush cleaning method such as the method in the photosensitive belt cleaner 13 described above. The cleaner in FIG. 19 has such a construction that the carrier fallen off from the developing roll is collected by arranging a magnet roll 471 and a scraping blade 472 in a upper position. In the embodiment of the color image forming apparatus according to the present invention shown in FIG.1, the disposed toner and the disposed carrier transported from the photosensitive belt cleaner 13 and the intermediate transfer drum cleaner 13 are transported to the toner box 14 in FIG.1 through transporting means 474 having a rotating spiral in its pipe.

Since the paper after receiving image has remaining charge due to transfer in the reverse surface, the paper sticks to the intermediate transfer drum 2 and, in some cases, cannot be peeled off the gravity only, and while the paper after peeled off is passing through the transporting path to the fixing unit, discharge takes place with the parts placed around to disturb the image. In this embodiment, the discharger is provided to easily peel off the paper from the intermediate transfer drum 2 and to prevent the occurrence of discharge on the transporting path to the fixing unit. Although the discharging mechanism utilizing AC corona discharge is used in the embodiment of FIG.1 according to the present invention, it is possible to employ a method where a conductive brush is contacted to the reverse surface of the paper.

Figure 20:
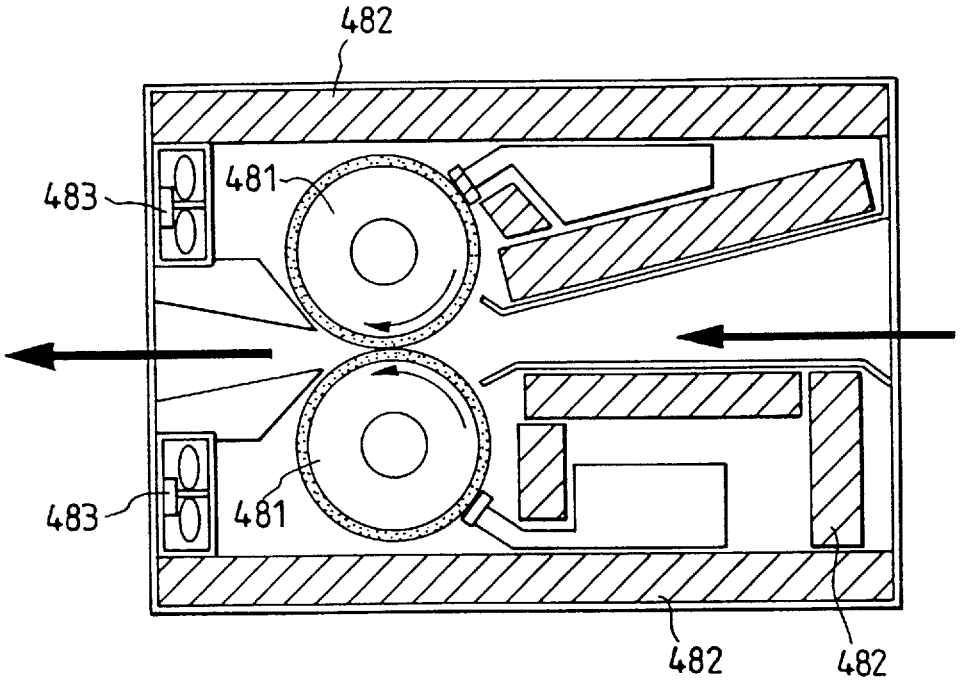
FIG. 20 is a view explaining the details of the construction of a fixing unit.

In the embodiment of the color image forming apparatus according to the present invention shown in FIG. 1, a roller fixing unit 20 shown in FIG. 20 is arranged. The process speed in the embodiment is 95 mm/s as described above. The outer shape and the fixing temperature of the fixing rollers 481 are generally determined by the supplied heat, the distance of the nip portion nipping the paper and the pressure. Using the construction of a conventional fixing unit used in a printer utilizing electro-photographic method, for the fixing roller 481 of a fixing unit applicable to the process speed in the embodiment it is proper that the fixing temperature is 100 to 200°C and the diameter of the fixing roller is around 30 mm. However, these setting values largely depend on the characteristics of the toner material used. The roller 481 of the fixing unit in the embodiment of the color image forming apparatus according to the present invention shown in FIG. 1 has a diameter of approximately 30 mm, and this size is small enough to be arranged under this construction of the apparatus.

If the heat inside the fixing unit is conducted to the toner containing chamber unit of the developing unit and the like, the toner in the developing unit or in the toner containing chamber is melted and freezed to cause a trouble. Therefore, it is necessary to provide a thermal insulating member 482 such as a foamed resin plate between the fixing unit and the developing unit and the toner containing chamber. Further, it is necessary to provide a heat exhausting mechanism having a heat exhausting fan 483 for exhausting heat in the paper putting-out direction. In the embodiment according to the present invention shown in FIG. 1, the unit is constructed in such that the top side and the down side are surrounded with thermal insulating members 482 and heat exhausting fans are provided to blow out the heat in the paper putting-out direction.

Figure 21:
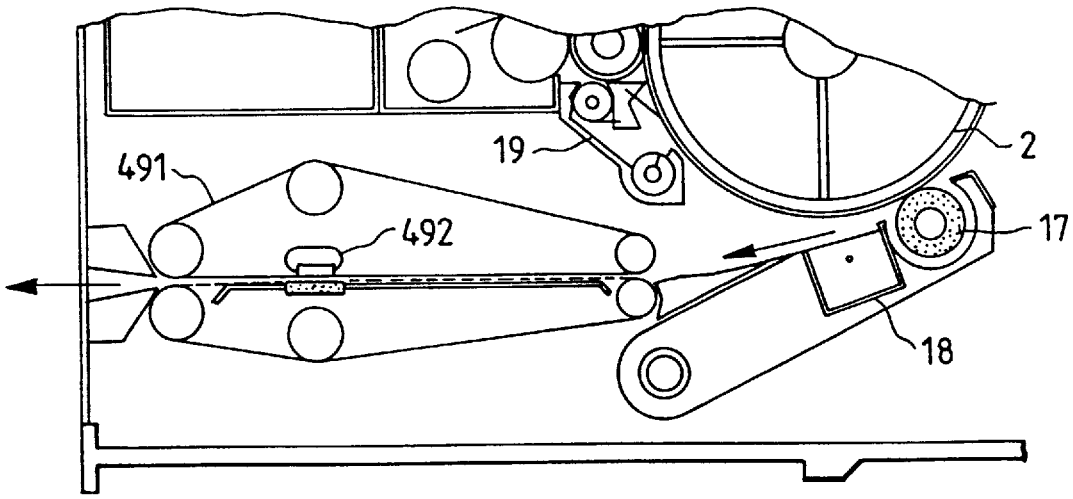
FIG. 21 is a view explaining another embodiment of a fixing unit.

As for another method in connection with the fixing unit, it is effective to employ a method using a heater fixed to the fixing position and a belt-shaped transporting member. FIG. 21 shows an embodiment employing the fixing method using a belt-shaped transporting member 491 and a fixed heater 492 applied to the embodiment according to the present invention shown in FIG. 1 In this method, the amount of heat generated in the fixing unit can be deceased, and the position of the heat source of the fixing unit can be freely set since the heat is transported by the belt. By arranging the entrance for the belt of the fixing unit near the transferring and peeling position of a paper, it is possible to print an image on a small sized paper since the distance transporting a paper from the transfer roller 17 to the fixing unit 20 can be shorten.

Figure 22:
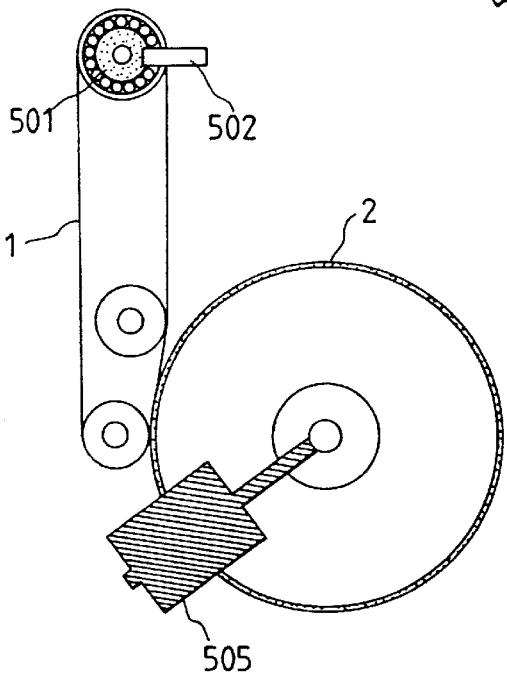
FIG. 22 is a view explaining the construction of a driving system.
Figure 23:
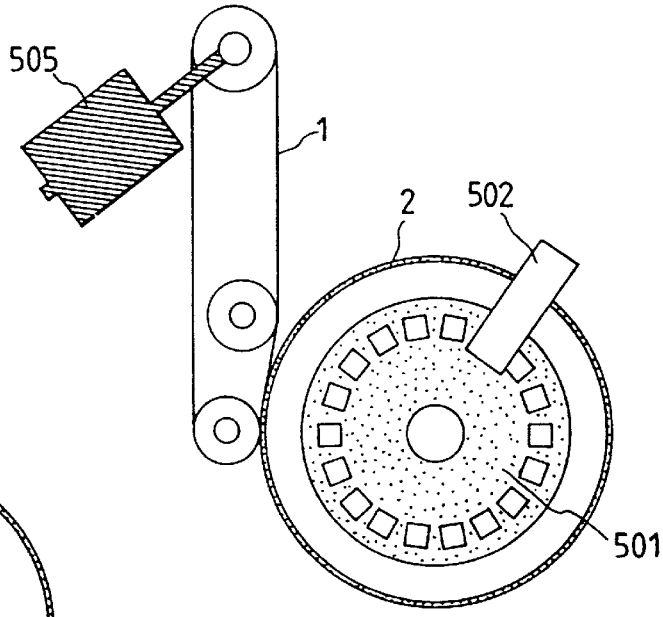
FIG. 23 is a view explaining the construction of another embodiment of a driving system.

The driving mechanism for the photosensitive belt 1 and the intermediate transfer drum 2 shown in FIG. 1 will be described below. In order to accurately superpose images of respective colors, it is necessary to drive the photosensitive belt 1 and the intermediate transfer drum 2 in perfect synchronization. As the driving method, it can be considered to use two pulse motors and control the rotations of the both members with a high accuracy. However, in order to perform such control, an extremely high accurate motor control and very high accuracies of dimensions in the diameter of the intermediate transfer drum and various parts of the photosensitive belt are required. Therefore, this embodiment employs such a driving method where a driving motor 505 is connected to the intermediate transfer drum 2 and the photosensitive belt 1 is driven by the intermediate transfer drum as shown in FIG. 22. The rotating speed is controlled constant by detecting the rotating speed with a rotating speed detecting disk 501 provided in the center of the roller for the photosensitive belt 1 and a rotating speed detecting sensor 502 for the rotating speed detecting disk. Another embodiment is shown in FIG. 23 where the roller inside the photosensitive belt 1 is driven by the motor, the rotating speed detecting disk 501 and the rotating speed detecting sensor 502 are provided in the intermediate transfer drum 2, and the photosensitive belt 1 and the intermediate transfer drum 2 are driven by the roller inside the photosensitive belt.

Figure 24:
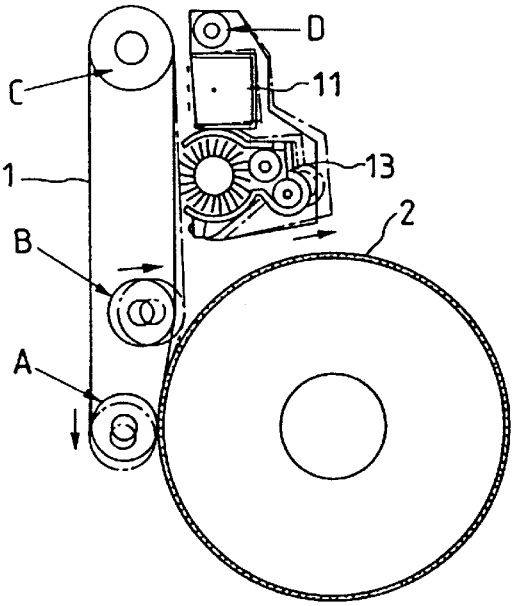
FIG. 24 is a view showing the direction of a tensile force given to the photosensitive body unit in the apparatus in FIG. 1 and a member to give the tensile force.

The mechanism to give tensile force to the photosensitive belt 1 will be described below. In order to absorb the increase in the length of the belt due to long use or the deflection of the belt when it contacts to the intermediate transfer drum 2, it is necessary to provided a mechanism to adjust its tensile force. FIG. 24 shows the direction of a tensile force given to the photosensitive belt unit in the color image forming apparatus according to the present invention shown in FIG. 1 and a member to give the tensile force. The extension of the belt is absorbed mainly by the roller A and the deflection of the belt during contacting with the intermediate transfer drum is absorbed by the rollers A and B. In this construction, the tilting angle of the belt between the roller B and the roller C is changed a little due to the displacement of the position of the roller B toward the side of the intermediate transfer drum. Therefore, in this embodiment, the charging unit 11 and the photosensitive belt cleaner unit 13 are constructed so as to displace as a unit in the direction indicated by an arrow in the figure. Among the rollers inside the photosensitive belt in an apparatus having a tensile force adding mechanism to the photosensitive belt 1, the inner roller C used as a guide in the laser beam exposing position inside the photosensitive belt is not provided with the tensile force adding mechanism in this embodiment.

Figure 25:
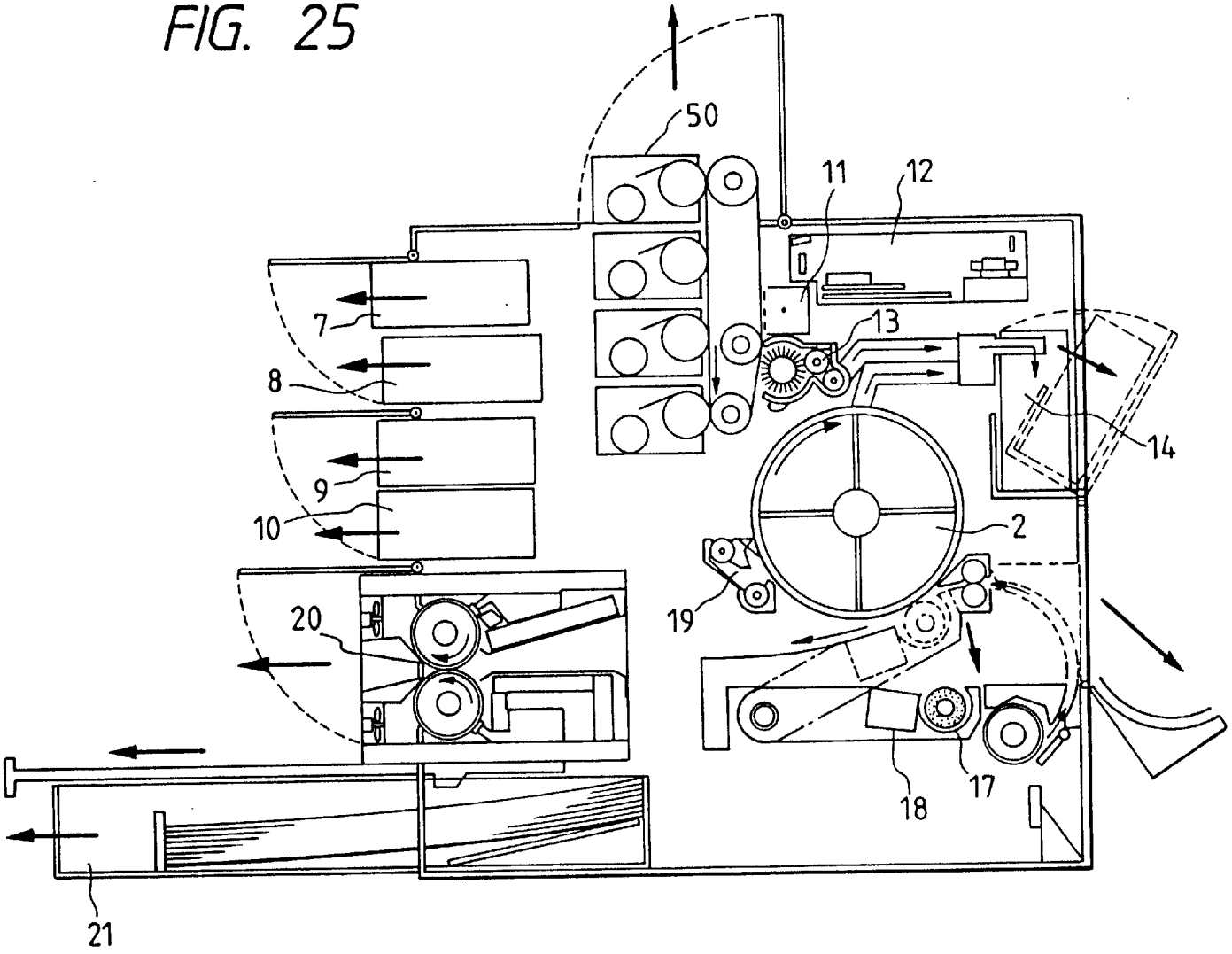
FIG. 25 is a view showing the dismounting constructions of individual parts and the inserting directions of parts in the apparatus shown in FIG. 1.

FIG. 25 shows the dismounting constructions of individual parts and the inserting directions of parts in the color image forming apparatus according to the present invention shown in FIG. 1 The embodiment of the color image forming apparatus according to the present invention has a construction to be operated from the left hand side in the figure as the front side. The paper tray 21 is inserted from the front of the apparatus as shown in the figure. A paper is inserted from the front side and turned back to be transported to the transfer roller 17 arranged diagonally under the intermediate transfer drum 2. The paper after receiving an image is peeled off in the direction of the gravity and then put out above the paper cassette 21 through the fixing unit 20 arranged under the developing units 3 to 6 as shown in the figure, the cover of the paper cassette 21 has a slidable structure and may be used as a paper tray for put-out papers.

The toner containing chamber units 7 to 10 are inserted also from the operating face in the left hand side of the figure, and the photosensitive-belt-and-developing unit 50 is inserted from the top. On the back surface there is a door for the disposed toner box 14 which falls together with the door by opening it as shown in FIG. 25 to mount and dismount easily from the upper side.

In the lower portion of the back surface there is also a door for curing jamming. The transfer unit has a construction such as to be movable downward to remove a jammed paper when a paper is jammed. However, when a paper of A4 size is jammed, the jammed paper may be removed, in most cases, through the exit of the paper cassette 21 or the fixing unit since the apparatus is small sized. Otherwise, since the fixing unit 20 is formed in a unit structure and can be drawn from the front as described above, the jammed paper may be removed by taking off the fixing unit.

Figure 26:
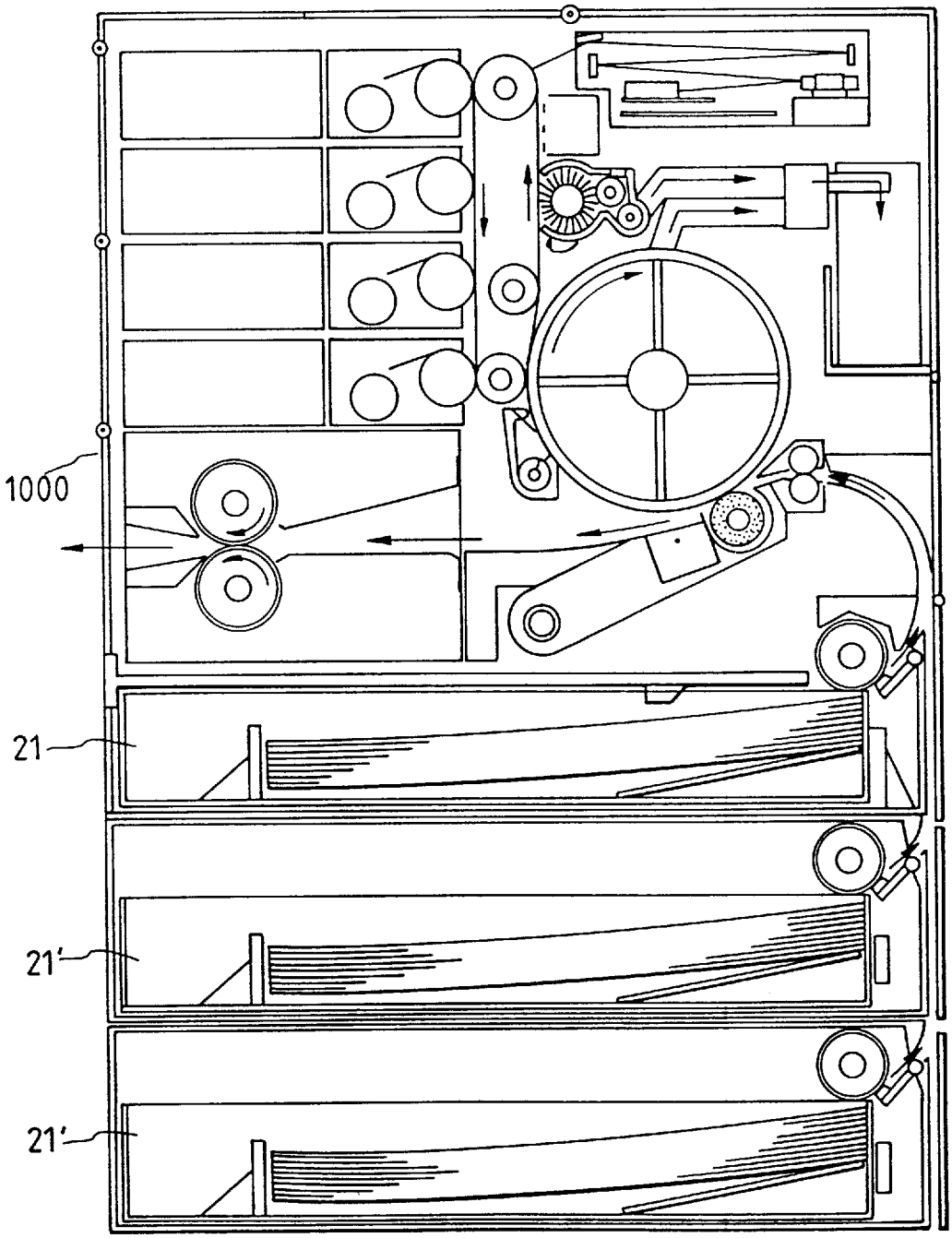
FIG. 26 is a view showing an embodiment added with a paper cassettes.

In a construction where a paper cassette is arranged in a lower position, it is possible to easily add other additional paper cassettes 21' under the main paper cassette 21 as shown in FIG. 26.

Although the embodiment of the color image forming apparatus according to the present invention shown in FIG. 1, as described above, is aimed at printing of A4 size papers, it is clear that a color image forming apparatus capable of printing an A3 size paper by increasing the dimensions of its parts a little. However, in a high-image-quality color image forming apparatus having resolution more than 400 dpi as one according to the present invention, it is possible without degradation in image quality to scale the A3 image down to an A4 down-sized print through software processing. Printing on a large size paper consumes a lot of toner in printing, and requires much more toner especially in a color image print often having a high printing area ratio. Further, the amount of image information for printing becomes more than nearly 100M Bytes as described above. With considering these facts, in a small-size color image forming apparatus easily used on a desk-top as the apparatus according to the present invention, a printing apparatus for A4 size paper is thought to be proper. In this sense, the embodiment according to the present invention has been described based on the size and dimensions of apparatuses for A4 size paper printing.

Figure 27:
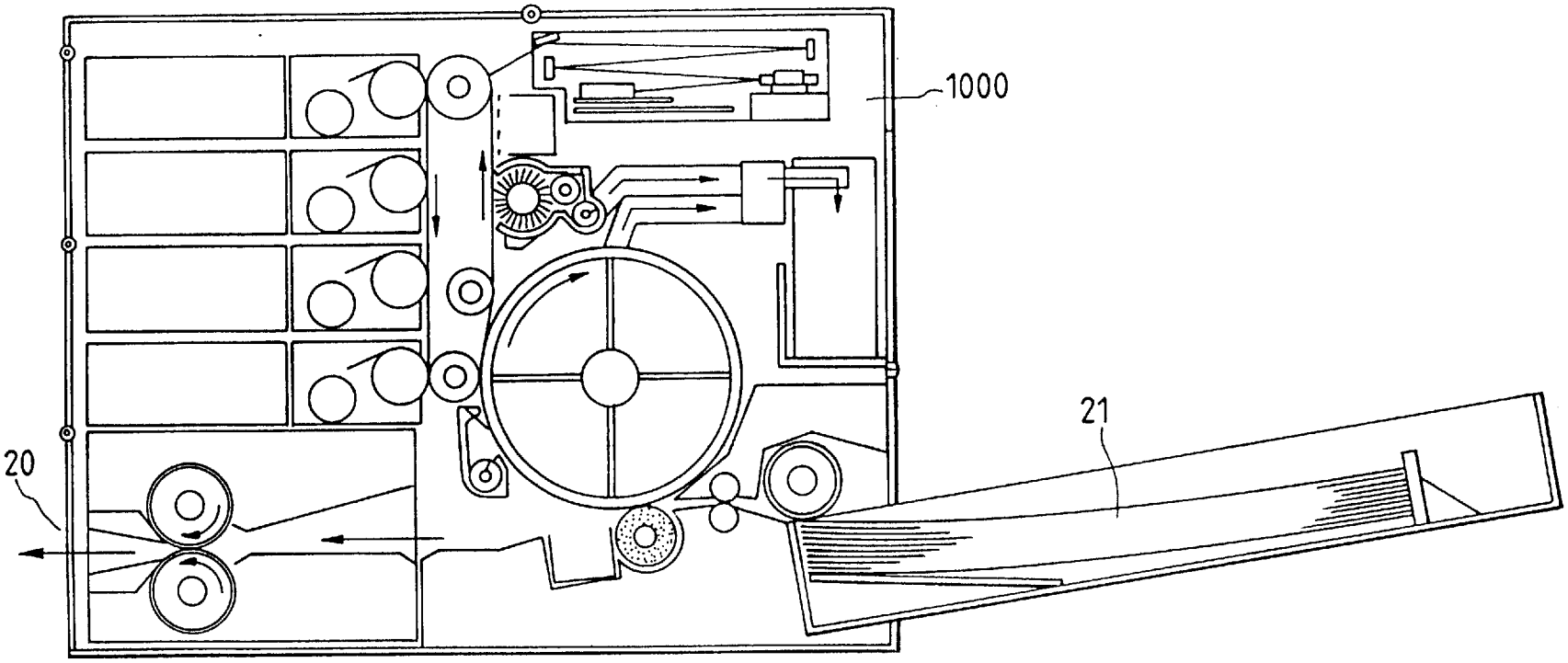
FIG. 27 is a view explaining another embodiment regarding paper transportation.

FIG. 27 is a view explaining another embodiment in regard to paper transportation according to the present invention. A paper cassette 21 is inserted from the right hand side in the figure, and a paper is transported in the horizontal direction and discharged in the right hand side. Since the paper cassette 21 is not placed in the bottom portion in this construction, the height of the entire apparatus can be lowered. In the construction of the embodiment in FIG.27, the height of the main body of the printing apparatus is approximately 230 mm. However, since the color image forming apparatus requires to be operated from both the left hand side and the right hand side, there is a disadvantage in that the apparatus requires more room for installation comparing to the construction of the embodiment in FIG. 1.

Figure 28:
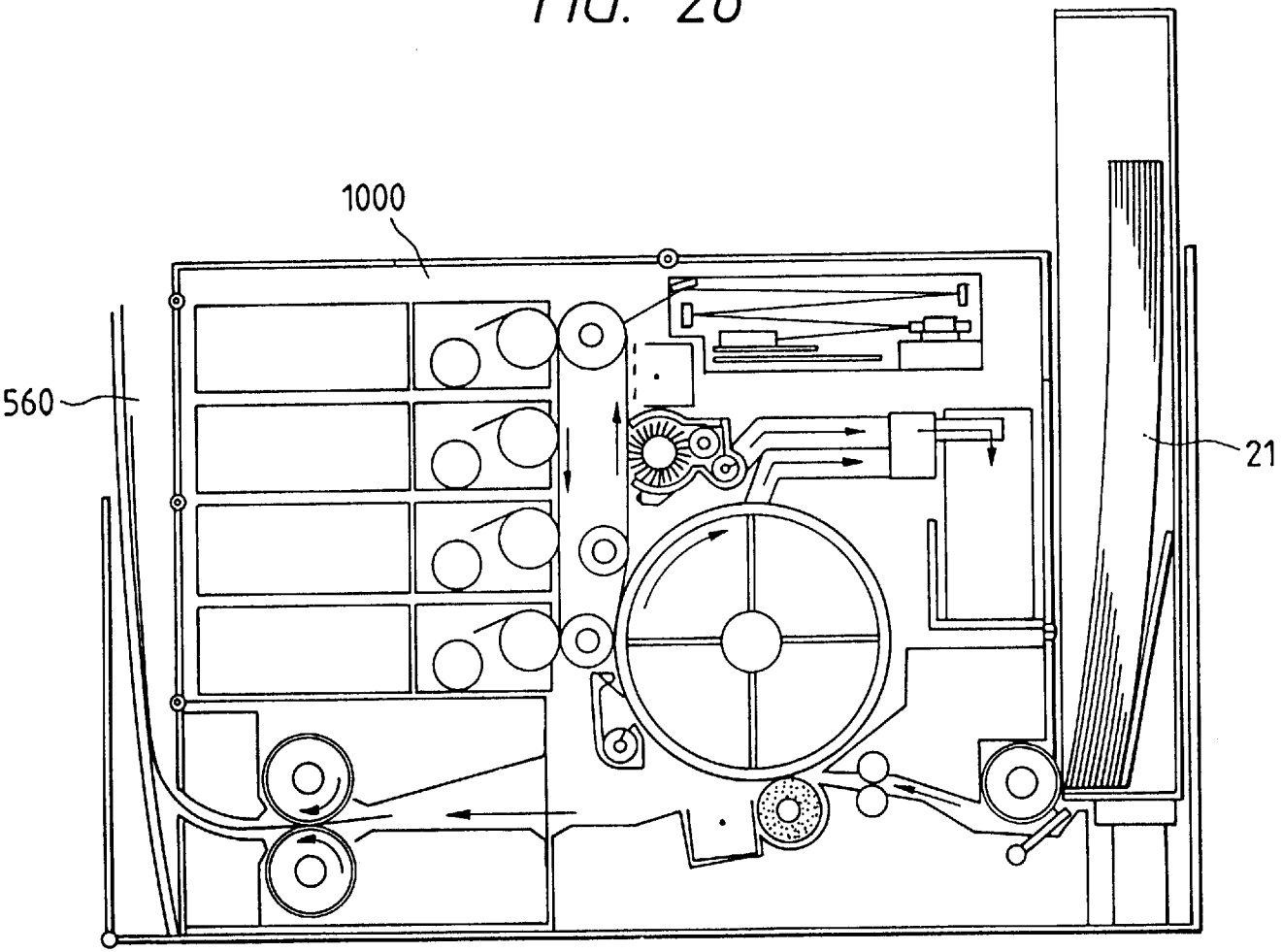
FIG. 28 is a view explaining another embodiment regarding paper transportation.

FIG. 28 is a view explaining another embodiment in regard to paper transportation according to the present invention. The paper cassette 21 is inserted from the top side of the main body of the printing apparatus 1000 to be vertically placed. The printed paper is vertically discharged to a vertical paper discharging tray 560. In this construction, the upper portion of the paper tray can be folded when the toner containing chamber units are inserted. With this construction, it is possible to realize an apparatus height nearly equal to the height of the embodiment of FIG. 27 and a comparatively small installing space. However, since the direction of drawing a paper from the paper tray is in the direction of the gravity, it is necessary that the shape of a separating pad for picking a paper from a pick roller is formed with high accuracy and to set the pushing pressure of the pick pad stably.

Figure 29:
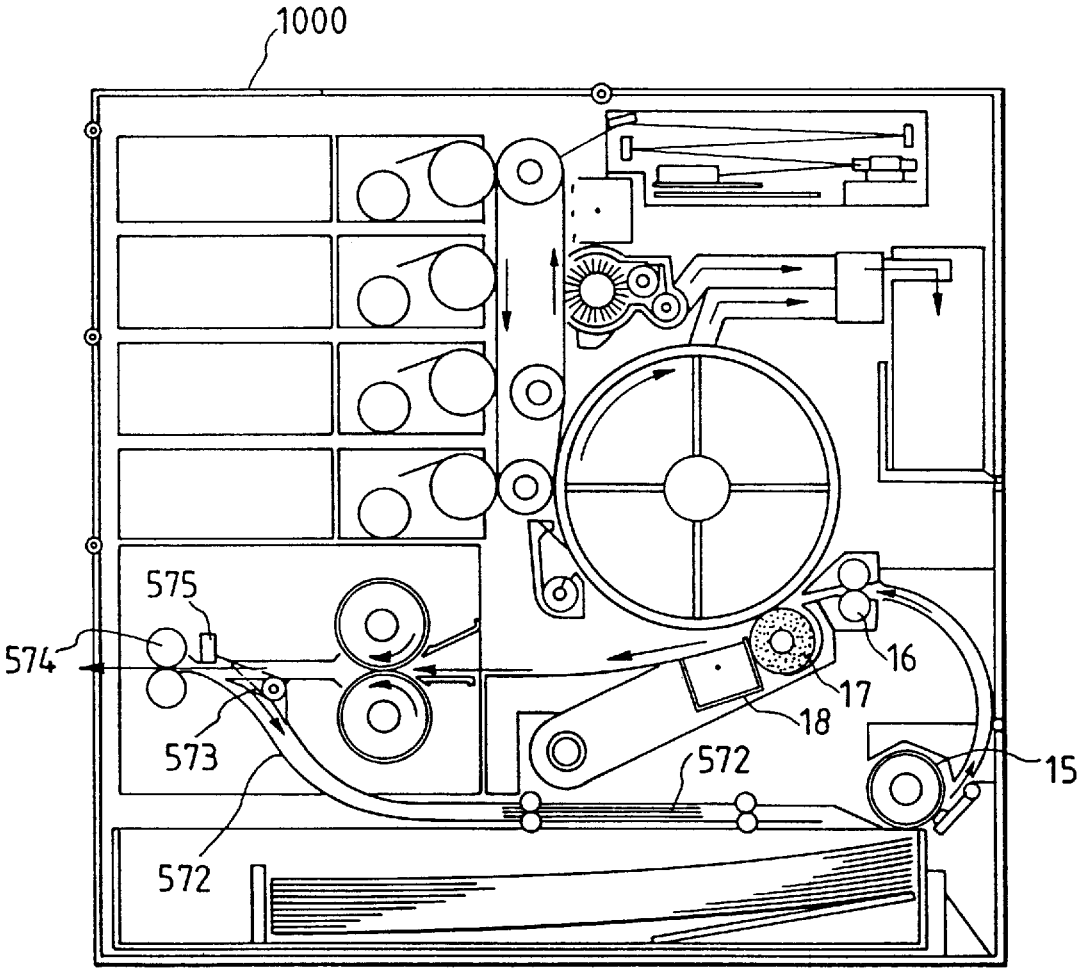
FIG. 29 is a view explaining another embodiment regarding paper transportation.

FIG. 29 is a view explaining another embodiment in regard to paper transportation according to the present invention. In this apparatus, a paper after fixed is put between auxiliary rollers 574, passing through a return transporting path 572 provided on the top surface of the paper cassette with aid of a transporting direction switching tab 573 by detecting the edge of the paper using a paper edge detecting sensor 575, then being printed after passing through a pick-up roller 15 and resist rollers 16. By doing so, color printing is performed on the both side surface of the paper. The aim of the apparatus is to reduce its size. Therefore, the apparatus not requiring to change its size has been shown in the figure as an embodiment. Although there are other methods to install a switch-back mechanism for both-side printing inside an apparatus, these require to increase the size of the apparatus.

Figure 30:
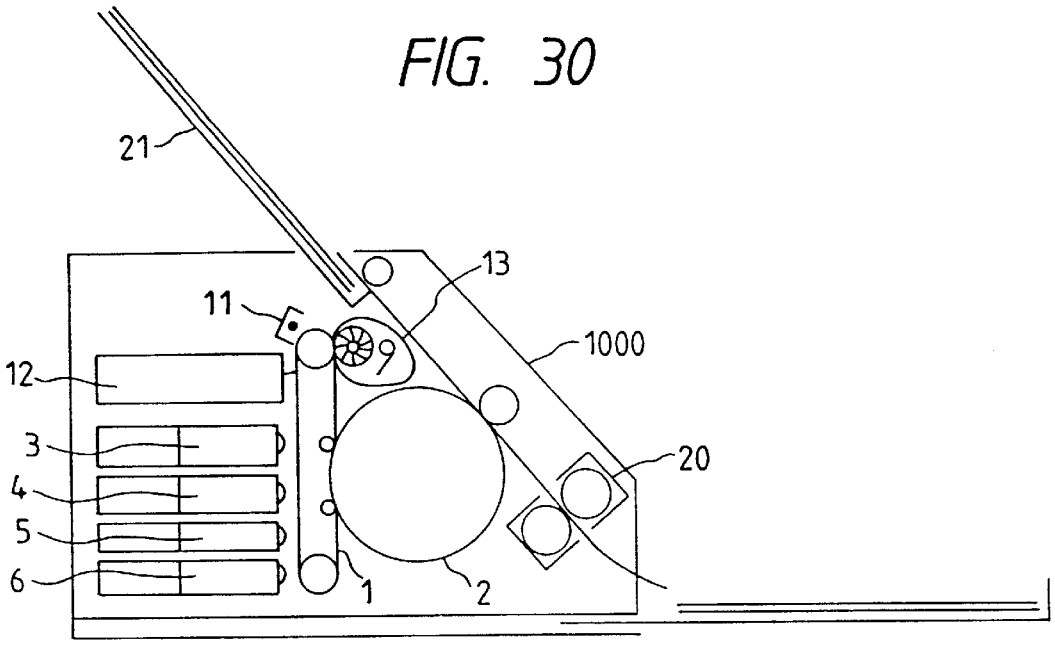
FIG. 30 is a view explaining another embodiment regarding paper transportation.

In the construction of an apparatus shown in FIG. 30, the paper cassette is mounted not inside the apparatus, but outside the apparatus when printing is performed. A paper is transported through an inclining path to be printed and fixed. In this case, the laser exposing unit 12 is arranged above the developing units and toner cassettes. Since the intermediate transfer drum 2 is arranged beside the middle portion of the photosensitive belt 1, it is necessary to provide auxiliary rollers in order to lengthen the nip between the intermediate transfer drum 2 and the photosensitive belt 1. By arranging so, it is possible to make the size of the apparatus small and to improve the printing speed owing to straightening the paper transporting path.

As having been described above, a color laser printer of desk-top type can be realized by employing a belt-shaped photosensitive medium arranging the photosensitive belt in stretching vertically, arranging developing units having different colors by stacking in one side of the photosensitive belt 1, arranging an intermediate transfer drum in the other side of the photosensitive belt opposite to the side arranging the developing units, placing the other mechanisms in the positions respectively so as to decrease the apparatus size, and arranging a paper cassette, a paper transporting mechanism and so on so as to contribute the small-sizing.

In the aforementioned embodiments, a printing paper is nearly straightly transported in the horizontal or inclined direction. Description will be made below on an embodiment where a transported path is provided vertically.

Figure 31:
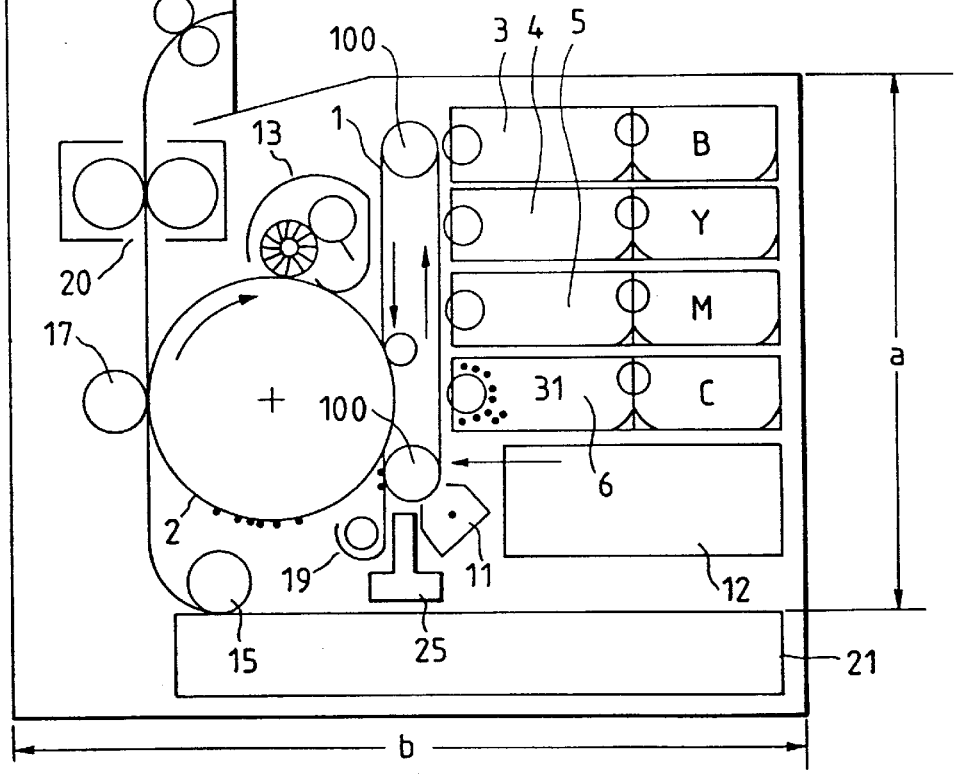
FIG. 31 is a view explaining another embodiment regarding paper transportation.

FIG. 31 shows the construction of another embodiment according to the present invention.

In this figure, a photosensitive belt is stretched vertically similar to in the apparatus of FIG. 1. Developing units 3, 4, 5, 6 are stacked vertically and arranged beside one side (in the right hand side in this embodiment) of the photosensitive belt 1. An intermediate transfer drum 2 is placed in the other side (in the left hand side in this embodiment) of the photosensitive belt 1, and a paper cassette 21 is placed under the photosensitive belt 1. A fixing unit 20 is placed above the intermediate transfer drum 2.

A paper picked-up from the paper cassette 21 with a pick-up roller 15 is transported in the vertical direction, and a toner image formed on the intermediate transfer drum 2 is transferred to the paper with a transfer roller 17 and fixed on the paper with the fixing unit 20. Then the paper is discharged on the top of the apparatus. The photosensitive belt 1 having an organic photosensitive medium is vertically stretched with belt driving rollers 100 and rotated in the counter-clock-wise direction. The photosensitive belt is negatively and uniformly charged with a charging unit 11. Then, a laser beam modulated by image information is irradiated from an exposing unit 12 on the photosensitive belt to form an electrostatic latent image of negative type. The electrostatic latent image is reversely developed with the developing unit 6 for cyanic toner containing cyanic toner negatively charged. The cyanic toner image formed is electrostatically transferred to the intermediate transfer drum 2. This image process is repeated for magenta toner (M), yellow toner (Y) and black toner (B) to form a full-color toner image by transfer and superpose on the intermediate transfer drum 2. This full-color toner image is transferred to a paper 7 using the transfer roller 17 subjected with positive voltage, and heated with the fixing unit 20 having a heat roller to be melted and fixed. Then the paper is discharged with the printed surface facing downward on the top of the apparatus. The remaining toner not used in printing on the photosensitive belt is removed with a cleaning unit 19 having a blade. The remaining charge on the photosensitive belt is eliminated with an eraser 25. The remaining toner on the intermediate transfer drum 2 is removed by being attracted to the cleaning unit 19 having a conductive brush roller with subjected with positive voltage.

The different point in this invention from that of FIG. 1 is that the exposing unit 12 is placed in the side of the developing unit and the position of transferring a toner image from the intermediate transfer drum 2 is arranged in such as to be in the lateral direction not under the intermediate transfer drum 2. By arranging so, maintenance of each part can be performed easily. In this invention, attaching and detaching of the photosensitive belt is performed from the upside by opening the top surface, maintenance of the developing unit is performed by opening the side surface in one side (in the side arranging the developing units) and displacing it in the horizontal direction. When paper jamming occurs, curing is performed by opening the side surface in the other side (in the side of the transporting path). Therefore, there is an advantage in that attaching and detaching of the photosensitive belt or the developing units is easy and removing operation of jammed paper is easy.

This construction is for transporting a laterally oriented paper of A4 size (211 mm ×297 mm). The margin of image on the photosensitive belt 1 in printing is set to approximately 70 mm. Therefore, the length per one picture is approximately 280 mm. The peripheral lengths of the photosensitive belt 1 and the intermediate transfer drum are made agreeing with this length, and the diameter of the belt driving roller 100 is set to 20 mm. Thus the distance between the center of the belt driving rollers 100 becomes 110 mm, and the diameter of the intermediate transfer drum becomes 90 mm. By closely mounting the printer composition elements such as the developing units, the exposing unit, the fixing unit and so on around the photosensitive belt 1 and the intermediate transfer drum 2 as shown in FIG. 31, the size of the printer becomes, as shown in FIG. 31, height of a=210 mm and width of b=290 mm which is nearly equal to the size of A4 paper. Therein, the size means a substantial cross-sectional size of the printer except the paper cassette 21 of which the size changes depending on the amount of containing paper. Therefore, the cross-sectional size of a printer for transporting a longitudinally oriented paper of A4 size is smaller than height of 1.25 times of a and width of 1.5 times of b because the length of paper increases about 1.5 times which is the aspect ratio of A4 size paper.

Figure 32:
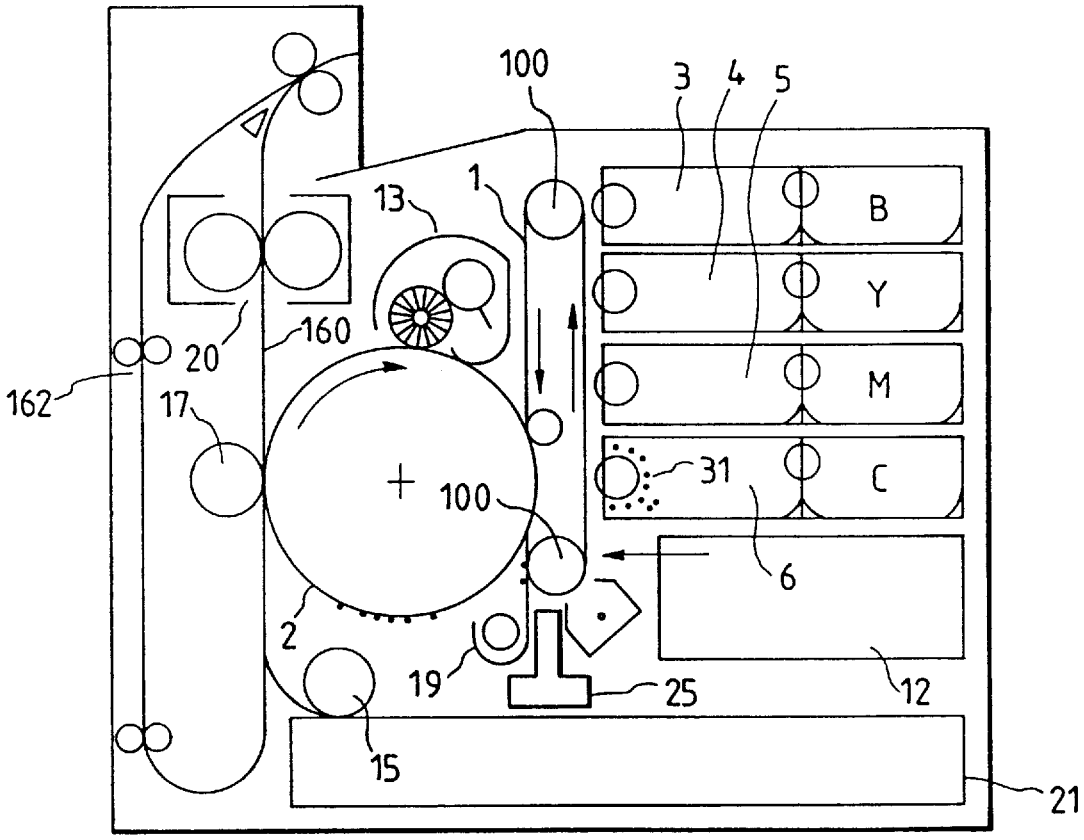
FIG. 32 is a view explaining another embodiment regarding paper transportation.

FIG. 32 shows another embodiment in regard to paper transportation where the construction of FIG. 31 is modified so as to perform both side printing by switch back a printing paper.

In the figure, a paper printed one side is not discharged after fixing, but is put between pinch rollers 150 and the pinch rollers are reversely rotated to be transported in a second transporting path 162 from the bottom side to the top side by operation of a first switch 161 for paper switching. Then in the bottom portion of the apparatus, the transportation of the paper is turned reverse so that the paper is transported from the bottom side to the top side to transfer an image formed on the intermediate transfer drum to the reverse surface side of the paper using the transfer roller 17. Removal of a jammed paper is performed from the horizontal direction by opening the side surface of the apparatus as similar to in the one-side printing described above. By constructing as this embodiment, it is possible to provide an apparatus capable of performing both-side printing without increasing apparatus size.

It is no need to say that the apparatus of FIG. 32 is added with a multi-stage paper cassette shown in FIG. 26.

As having been described, according to the present invention, it is possible to provide a small-size color laser printer easily usable on desk-top which is small in size, high in image quality, easy in maintenance.

What is claimed is:

1. A color electro-photographic apparatus, comprising:

a photosensitive belt disposed for movement along a path in which a major portion of the path extends in a substantially vertical direction;

a plurality of developing units arranged in a stack along one side of said photosensitive belt;

an intermediate transfer body disposed adjacent an other side of said photosensitive belt at a lower portion thereof; and a paper cassette extending in a horizontal direction at a part of said apparatus below said photosensitive belt so that paper travels from an end of the paper cassette along a vertical path without bending back upon itself prior to image transfer by the intermediate transfer body.

2. A color electro-photographic apparatus according to claim 1, wherein after image transfer, the paper travels along a path which bends back upon itself so that when the paper exits from the color electro-photographic apparatus, the paper has the transferred image on a lower side thereof.

3. A color electro-photographic apparatus according to claim 1, wherein said photosensitive belt is a photosensitive body for forming image data by at least two colors and said photosensitive belt has a length of 220 to 470 mm.

4. A color electro-photographic apparatus according to claim 3, wherein each of said plurality of developing units is of a non-magnetic one-component developing type.

5. A color electro-photographic apparatus according to claim 1, wherein said intermediate transfer body is arranged for successively superposing a toner image of a different color on said photosensitive belt to produce a color toner image, a transfer unit is provided for transferring said color toner image superposed on said intermediate transfer body to a printing medium, and a fixing unit fixes the color toner image onto said printing medium.

6. A color electro-photographic apparatus according to claim 5, wherein said intermediate transfer body has an outer peripheral length of 210 to 420 mm.

7. A color electro-photographic apparatus according to claim 6, wherein said intermediate transfer body is a drum having a diameter of about 70 to 150 mm.

8. A color electro-photographic apparatus, comprising:

a printing structure having a photosensitive belt, a plurality of developing units and an intermediate transfer body, said photosensitive belt disposed for movement along a path in which a major portion of the path extends in a substantially vertical direction, said plurality of developing units being arranged in a stacked relation to one side of said photosensitive belt , said intermediate transfer body being disposed adjacent to an other side of said photosensitive belt opposite said one side of said photosensitive belt at a lower portion of said photosensitive belt;

a fixing unit for fixing an image transferred on a paper sheet by said intermediate transfer body;

a paper cassette for storing the paper sheet; and a paper path for the paper sheet, the paper sheet being transported along the paper path without bending back upon itself at least between a portion of the paper path in proximity to an exit end of said paper cassette and said fixing unit.

9. A color electro-photographic apparatus according to claim 8, wherein said paper path is formed so as to extend along a peripheral portion of said printing structure.

10. A color electro-photographic apparatus according to claim 8, wherein the paper sheet is transported between at least the portion of the paper path in proximity to the exit end of said paper cassette and said fixing unit in a substantially vertical direction.

11. A color electro-photographic apparatus, comprising:

a photosensitive belt disposed for movement along a path in which a major portion of the path extends in a substantially vertical direction;

an exposing unit disposed with respect to one side of said photosensitive belt;

a plurality of developing units arranged in a stacked relation to said photosensitive belt;

an intermediate transfer body arranged in relation to said photosensitive belt at a lower portion thereof; and a fixing unit arranged at a portion above said intermediate transfer body;

wherein said developing units and said intermediate transfer body are respectively disposed on opposite sides in relation to said photosensitive belt.

12. A color electro-photographic apparatus according to claim 11, wherein said exposing unit and said intermediate transfer body are arranged on said one side of said photosensitive belt.

13. A color electro-photographic apparatus according to claim 11, wherein said exposing unit and said plurality of developing units are arranged on said one side of said photosensitive belt.

14. A color electro-photographic apparatus according to claim 11, wherein said photosensitive belt is a photosensitive body for forming image data by at least two colors and said photosensitive belt has a length of 220 to 470 mm.

15. A color electro-photographic apparatus according to claim 14, wherein each of said plurality of developing units is of a non-magnetic one-component developing type.

16. A color electro-photographic apparatus according to claim 11, wherein said intermediate transfer body is arranged for successively superposing a toner image of a different color on said photosensitive belt to produce a color toner image, a transfer unit is provided for transferring said color toner image superposed on said intermediate transfer body to a printing medium, and a fixing unit fixes the color toner image onto said printing medium.

17. A color electro-photographic apparatus according to claim 16, wherein said intermediate transfer body has an outer peripheral length of 210 to 420 mm.

18. A color electro-photographic apparatus according to claim 17, wherein said intermediate transfer body is a drum having a diameter of about 70 to 150 mm.

19. A color electro-photographic apparatus, comprising:

a photosensitive belt disposed for movement along a path in which a major portion of the path extends in a substantially vertical direction;

a plurality of developing units stacked along one side of said photosensitive belt; and an intermediate transfer body adjacent an other side of said photosensitive belt at a lower portion thereof;

wherein said photosensitive belt moves in an upward direction along said plurality of developing units.

20. A color electro-photographic apparatus according to claim 19, wherein said photosensitive belt is a photosensitive body for forming image data by at least two colors and said photosensitive belt has a length of 220 to 470 mm.

21. A color electro-photographic apparatus according to claim 20, wherein each of said plurality of developing units is of a non-magnetic one-component developing type.

22. A color electro-photographic apparatus according to claim 19, wherein said intermediate transfer body is arranged for successively superposing a toner image of a different color on said photosensitive belt to produce a color toner image, a transfer unit is provided for transferring said color toner image superposed on said intermediate transfer body to a printing medium, and a fixing unit fixes the color toner image onto said printing medium.

23. A color electro-photographic apparatus according to claim 19, wherein said intermediate transfer body has an outer peripheral length of 210 to 420 mm.

24. A color electro-photographic apparatus according to claim 23, wherein said intermediate transfer body is a drum having a diameter of about 70 to 150 mm.

* * * * *